US011332926B2

(12) United States Patent
Ohtsu et al.

(10) Patent No.: US 11,332,926 B2
(45) Date of Patent: May 17, 2022

(54) SOUNDPROOF STRUCTURE

(71) Applicant: FUJIFILM Corporation, Tokyo (JP)

(72) Inventors: Akihiko Ohtsu, Ashigara-kami-gun (JP); Shinya Hakuta, Ashigara-kami-gun (JP); Shogo Yamazoe, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 477 days.

(21) Appl. No.: 16/284,424

(22) Filed: Feb. 25, 2019

(65) Prior Publication Data

US 2019/0186126 A1 Jun. 20, 2019

Related U.S. Application Data

(63) Continuation of application No. PCT/JP2017/029749, filed on Aug. 21, 2017.

(30) Foreign Application Priority Data

Aug. 26, 2016 (JP) ..... JP2016-165569

(51) Int. Cl.

| | |
|---|---|
| ***E04B 1/84*** | (2006.01) |
| ***G10K 11/172*** | (2006.01) |
| ***E01F 8/00*** | (2006.01) |
| ***G10K 11/175*** | (2006.01) |
| ***G10K 11/162*** | (2006.01) |
| ***E04B 1/82*** | (2006.01) |

(52) U.S. Cl.

CPC ..... *E04B 1/84* (2013.01); *E01F 8/00* (2013.01); *G10K 11/162* (2013.01); *G10K 11/172* (2013.01); *G10K 11/175* (2013.01); *E04B 2001/8263* (2013.01); *E04B 2001/8452* (2013.01)

(58) Field of Classification Search

CPC ..... E04B 1/84; E04B 2001/8263; E04B 2001/8452; E01F 8/00; G10K 11/162; G10K 11/172; G10K 11/175

USPC ..... 181/284

See application file for complete search history.

(56) References Cited

U.S. PATENT DOCUMENTS

2005/0263343 A1* 12/2005 Yano ..... F01N 1/24 181/210
2018/0245334 A1* 8/2018 Udagawa ..... E04B 1/86

FOREIGN PATENT DOCUMENTS

DE 19509678 C1 5/1996
EP 0 798 426 A1 10/1997

(Continued)

OTHER PUBLICATIONS

Extended European Search Report dated Oct. 25, 2019 issued by the European Patent Office in counterpart application No. 17843523.6.

(Continued)

*Primary Examiner* — Forrest M Phillips
(74) *Attorney, Agent, or Firm* — Sughrue Mion, PLLC

(57) ABSTRACT

There is provided a soundproof structure capable of obtaining a sufficient soundproofing effect by suppressing the leaking of sound due to a diffraction phenomenon in a partition member used for soundproofing. A soundproof unit, which has a frame body having an opening portion and a film that is disposed so as to cover the opening portion and vibrates according to a sound incident on the film, and a partition member, to which one or more soundproof units are attached, are provided.

12 Claims, 20 Drawing Sheets

(56) References Cited

FOREIGN PATENT DOCUMENTS

| | | | | |
|---|---|---|---|---|
| EP | 2434066 | A1 * | 3/2012 | ..... E04B 9/0428 |
| JP | 62-266012 | A | 11/1987 | |
| JP | 08199701 | A | 8/1996 | |
| JP | 2001327348 | A | 11/2001 | |
| JP | 2002-220817 | A1 | 8/2002 | |
| JP | 2005-030046 | A | 2/2005 | |
| JP | 2005-163334 | A | 6/2005 | |
| JP | 2009-139556 | A | 6/2009 | |
| JP | 2011099319 | A | 5/2011 | |
| JP | 2011170003 | A | 9/2011 | |
| JP | 2012-188904 | A | 10/2012 | |
| JP | 5380610 | B2 | 1/2014 | |
| JP | 2015-132128 | A | 7/2015 | |
| KR | 10-0930101 | B1 | 12/2009 | |
| KR | 10-2013-0027916 | A | 3/2013 | |
| WO | WO-2007031290 | A1 * | 3/2007 | ..... E04B 1/82 |

OTHER PUBLICATIONS

Communication dated Sep. 10, 2019 from Japanese Patent Office in counterpart JP Application No. 2018-535660.
International Search Report for PCT/JP2017/029749 dated Oct. 10, 2017 (PCT/ISA/210).
International Preliminary Report on Patentability dated Aug. 6, 2018 from the International Bureau in counterpart International application No. PCT/JP2017/029749.

* cited by examiner

SOUNDPROOF STRUCTURE

CROSS-REFERENCE TO RELATED APPLICATIONS

This application is a Continuation of PCT International Application No. PCT/JP2017/029749 filed on Aug. 21, 2017, which claims priority under 35 U.S.C. § 119(a) to Japanese Patent Application No. 2016-165569 filed on Aug. 26, 2016. The above application is hereby expressly incorporated by reference, in its entirety, into the present application.

BACKGROUND OF THE INVENTION

1. Field of the Invention

The present invention relates to a soundproof structure.

2. Description of the Related Art

Partition members, such as partitions, doors, and walls of rooms (buildings), or soundproof walls provided on highways, general roads, railroad tracks, and the like, are used for soundproofing. In such partition members used for soundproofing, due to the "diffraction phenomenon" in which the sound leaks from the upper portion or lateral portion of each partition member, there is a problem that a sufficient soundproofing effect cannot be obtained even in a case where the partition member is provided. In order to obtain a sufficient soundproofing effect, it is necessary to increase the height of the partition member.

In order to solve the diffraction phenomenon, it is considered to enhance the soundproofing effect by providing a sound absorbing material at the upper end portion of a plate member (partition member) to suppress the diffraction of the sound (JP5380610B). By providing an absorber at the upper end portion of the plate member, a sound pressure difference is generated between the front side and the back side of the plate member to increase the local speed of the sound, and the energy of the particle speed of the accelerated air is consumed by the sound absorbing material that is a porous body. In this manner, the soundproofing effect is obtained.

SUMMARY OF THE INVENTION

However, in a case where a sound absorbing body formed of a porous body is provided at the upper end portion of the partition member (plate member), the sound incident on the sound absorbing body is absorbed, but the sound passing through the upper portion of the sound absorbing body causes a diffraction phenomenon without being absorbed. Therefore, in the configuration in which the sound absorbing material that is a porous body is disposed at the upper end portion of the partition member, the soundproofing effect is not sufficient.

It is an object of the present invention to provide a soundproof structure capable of obtaining a sufficient soundproofing effect by suppressing the leaking of sound due to a diffraction phenomenon in a partition member used for soundproofing by solving the above-described problems of the conventional technique.

In order to achieve the aforementioned object, the present inventors have made intensive studies and as a result, have found that the above-described problems can be solved in such a manner that there are provided a soundproof unit having a frame body, which has an opening portion, and a film, which is disposed so as to cover the opening portion and vibrates according to the sound incident on the film, and a partition member to which one or more soundproof units are attached, thereby completing the present invention.

That is, it has been found that the aforementioned object can be achieved by the following configurations.

[1] A soundproof structure comprising: a soundproof unit that has a frame body, which has an opening portion, and a film, which is disposed so as to cover the opening portion and vibrates according to a sound incident on the film; and a partition member to which one or more soundproof units are attached.

[2] The soundproof structure described in [1], where, assuming that a total length of a thickness of the frame body in a penetration direction of the opening portion and an opening end correction distance is La and a sound speed in air is c, a relationship of $c/(4\ La) \leq 20000$ is satisfied.

[3] The soundproof structure described in [2], where, assuming that a total length of a thickness of the frame body in a penetration direction of the opening portion and an opening end correction distance is La and a sound speed in air is c, a relationship of $c/(4\ La) \leq 2000$ is satisfied.

[4] The soundproof structure described in [1], where, assuming that a total length of a thickness of the frame body in a penetration direction of the opening portion and an opening end correction distance is La, a first natural vibration frequency of the film is $f_1$, and a sound speed in air is c, a relationship of $c/(4\ La) \leq f_1$ is satisfied.

[5] The soundproof structure described in any one of [1] to [4], where the soundproof unit is attached to an end surface of the partition member.

[6] The soundproof structure described in [5], where the soundproof unit is attached to the end surface of the partition member such that a film surface of the film is parallel to a main surface of the partition member.

[7] The soundproof structure described in any one of [1] to [6], where the film is formed of an air-impermeable material.

[8] The soundproof structure described in any one of [1] to [7], where a first natural vibration frequency of the film of the soundproof unit is 20000 Hz or less.

[9] The soundproof structure described in any one of [1] to [8], where the first natural vibration frequency of the film of the soundproof unit is within an audible range.

[10] The soundproof structure described in any one of [1] to [9], where two or more soundproof units are arranged on an end surface of the partition member.

[11] The soundproof structure described in any one of [1] to [10], where the film of the soundproof unit has a through-hole.

[12] The soundproof structure described in any one of [1] to [11], where the frame body and the film of the soundproof unit are transparent.

[13] The soundproof structure described in any one of [1] to [12], where the soundproof unit has at least one of an attachable and detachable portion with respect to the partition member or an attachable and detachable portion with respect to another soundproof unit.

According to the present invention, it is possible to provide a soundproof structure capable of obtaining a sufficient soundproofing effect by suppressing the leaking of sound due to a diffraction phenomenon in a partition member used for soundproofing.

DESCRIPTION OF THE PREFERRED EMBODIMENTS

Hereinafter, the present invention will be described in detail.

The description of constituent elements described below may be made based on representative embodiments of the present invention, but the present invention is not limited to such embodiments.

The numerical range expressed by using "~" in this specification means a range including numerical values described before and after "~" as a lower limit and an upper limit.

In this specification, it is assumed that the terms "perpendicular" and "parallel" include the range of error accepted in the technical field to which the present invention belongs. For example, "perpendicular" and "parallel" mean within a range less than ±10° with respect to strictly perpendicular or parallel. The error with respect to strictly perpendicular or parallel is preferably 5° or less, more preferably 3° or less.

In addition, it is assumed that an angle expressed by something other than "perpendicular" and "parallel", for example, a specific angle such as 15° or 45°, includes a range of error allowed in the technical field to which the present invention belongs. For example, in the present invention, the angle means being less than ±5° with respect to the strictly specified angle, and the error with respect to the shown strict angle is preferably ±3° or less, and more preferably ±1° or less.

[Soundproof Structure]

A soundproof structure according to an embodiment of the present invention is a soundproof structure having a soundproof unit having a frame body, which has an opening portion, and a film, which is disposed so as to cover the opening portion and vibrates according to the sound incident on the film, and a partition member to which one or more soundproof units are attached.

The configuration of the soundproof structure according to the embodiment of the present invention will be described with reference to FIGS. 1 to 6.

Figure 1:
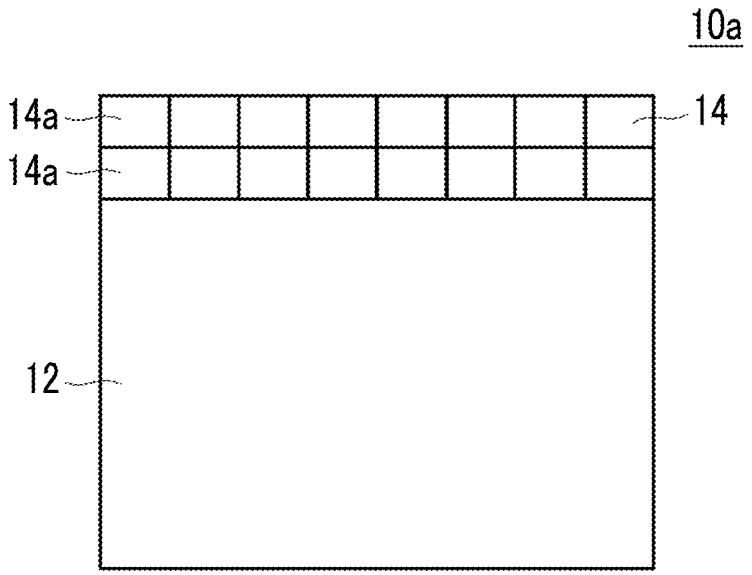
FIG. 1 is a front view schematically showing an example of a soundproof structure of the present invention.
Figure 2:
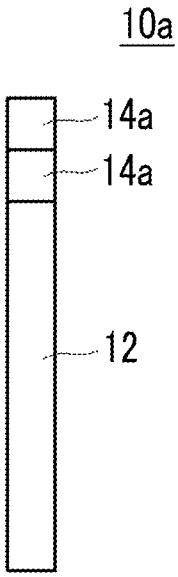
FIG. 2 is a side view of the soundproof structure shown in FIG. 1.
Figure 3:
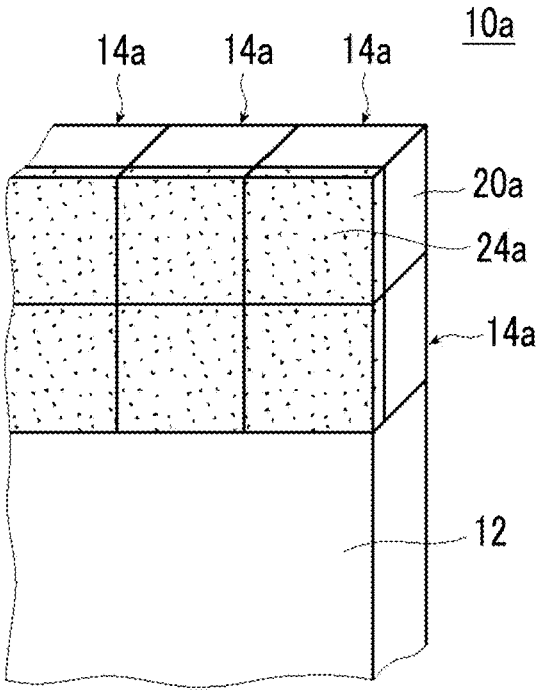
FIG. 3 is a partially enlarged perspective view of the soundproof structure shown in FIG. 1.
Figure 4:
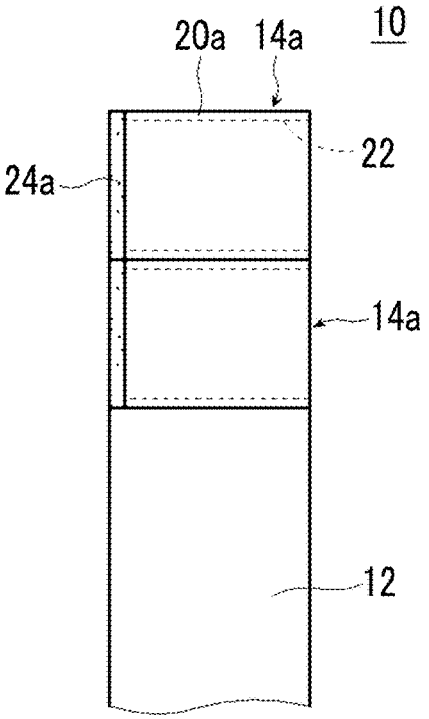
FIG. 4 is a partially enlarged side view of the soundproof structure shown in FIG. 1.
Figure 5:
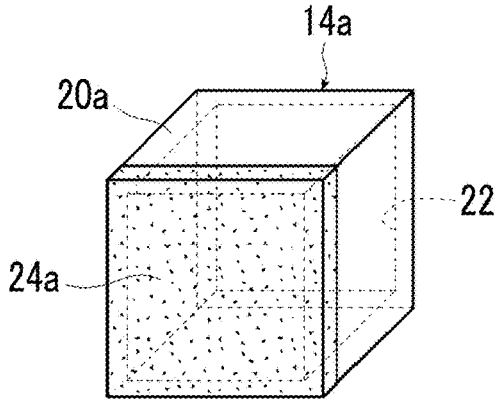
FIG. 5 is a perspective view schematically showing a soundproof unit of the soundproof structure shown in FIG. 1.

FIG. 1 is a schematic front view showing an example of a preferred embodiment of the soundproof structure of the present invention, FIG. 2 is a side view of the soundproof structure shown in FIG. 1, FIG. 3 is a partially enlarged perspective view of the soundproof structure shown in FIG. 1, and FIG. 4 is a partially enlarged side view of the soundproof structure shown in FIG. 1. FIG. 5 is a schematic perspective view showing one of soundproof units 14*a* forming the soundproof structure shown in FIG. 1, and FIG. 6 is a side view of the soundproof unit 14*a* shown in FIG. 5.

A soundproof structure 10*a* shown in FIGS. 1 to 4 has a plate-shaped partition member 12 and a plurality of soundproof units 14*a* arranged on the upper end surface (end surface on the upper side in the vertical direction in the diagrams) of the partition member 12.

In the example shown in FIG. 1, eight soundproof units 14*a* are disposed in the width direction on the upper end surface of the partition member 12, and the soundproof unit 14*a* is further disposed on each soundproof unit 14*a*. That is, the soundproof structure 10*a* has the partition member 12 and (8×2) soundproof units 14*a* arranged on the upper end surface of the partition member 12.

Figure 6:
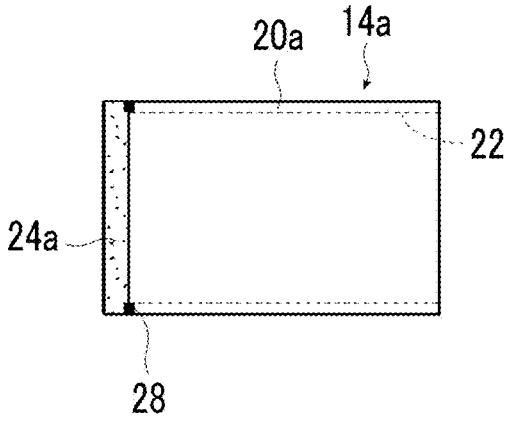
FIG. 6 is a side view of the soundproof unit shown in FIG. 5.

As shown in FIGS. 5 and 6, the soundproof unit 14*a* has a frame body 20*a* having an opening portion 22 passing therethrough and a film 24*a* disposed so as to cover one of the opening surfaces of the opening portion 22, and the film 24*a* vibrates according to the sound incident on the film 24*a*.

As shown in FIGS. 3 and 4, in the soundproof structure 10*a*, the thickness of the soundproof unit 14*a* in the penetration direction of the opening portion 22 (hereinafter, simply referred to as the thickness of the soundproof unit) is approximately equal to the thickness of the partition member 12.

In the shown example, all of the plurality of soundproof units 14*a* are disposed such that the film surface of the film 24*a* is parallel to the main surface (maximum surface) of the partition member 12 and the film surface of the film 24*a* and the main surface of the partition member 12 are even with each other. The plurality of soundproof units 14*a* are disposed with the films 24*a* facing the same direction so that the film surfaces of the respective films 24*a* are on the same surface.

The main surface of the partition member 12 is a maximum surface, and a surface whose normal vector faces the partitioned space in a case where the soundproof structure is provided at a target place.

The partition member 12 refers to a member, a wall, and the like separating two spaces from each other. Examples of the partition member 12 are various known plate-shaped members used for soundproofing, such as a fixed wall forming a building structure such as a house, a building, and a factory, a fixed wall such as a fixed partition disposed in a room of a building to partition the inside of the room, a movable wall such as a movable partition disposed in a room of a building to partition the inside of the room, doors, windows, and window frames of buildings, and soundproof walls provided on highways, general roads, and railroad tracks.

The material of the partition member 12 may be selected according to the application, desired function, and the like, and various metals, resins such as acrylic, glass, concrete, mortar, wood, and the like can be appropriately used.

The size of the partition member 12 is not limited, and may be appropriately set according to the application, desired function, and the like.

As described above, in such partition members used for soundproofing, due to the "diffraction phenomenon" in which the sound leaks from the upper portion or lateral portion of each partition member, there is a problem that sufficient soundproofing effect cannot be obtained even in a case where the partition member is provided.

Figure 7:
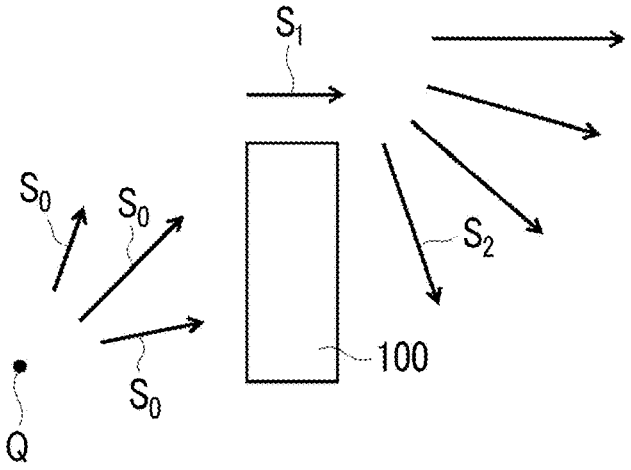
FIG. 7 is a diagram conceptually showing the propagation of sound waves in the case of a conventional soundproof structure.

Specifically, as shown in FIG. 7, a sound $S_0$ directed to a partition member 100 among sounds $S_0$ generated from a sound source Q is blocked by the partition member 100 and does not reach the back side of the partition member 100, but a sound $S_1$ passing through the upper portion of the partition member 100 leaks to the back side of the partition member 100 by the diffraction phenomenon as indicated by sound $S_2$. For this reason, a sufficient soundproofing effect cannot be obtained. Therefore, in order to obtain a sufficient soundproofing effect, it is necessary to increase the height of the partition member.

In order to solve the diffraction phenomenon, it is considered to enhance the soundproofing effect by providing a sound absorbing material formed of a porous body at the upper end portion of the partition member to suppress the diffraction of the sound. However, in a case where a sound absorbing body formed of a porous body is provided at the upper end portion of the partition member, the sound incident on the sound absorbing body is absorbed, but the sound passing through the upper portion of the sound absorbing body causes a diffraction phenomenon without being absorbed. Therefore, in the configuration in which the sound absorbing material that is a porous body is disposed at the upper end portion of the partition member, the soundproofing effect is not sufficient.

In contrast, the soundproof structure 10*a* according to the embodiment of the present invention has a configuration in which a plurality of soundproof units 14*a*, each of which has the frame body 20*a* having the opening portion 22 and the film 24*a* disposed so as to cover the opening portion 22, are arranged on the upper end surface of the partition member 12.

The soundproof unit 14*a* absorbs the incident sound by the film vibration of the film 24*a* to show the soundproofing effect, but a part of the incident sound passes through the film 24*a*. In other words, the sound pressure of the sound passing through the film 24*a* (film vibration) decreases. In addition, the phase of the sound passing through the film changes.

Figure 8:
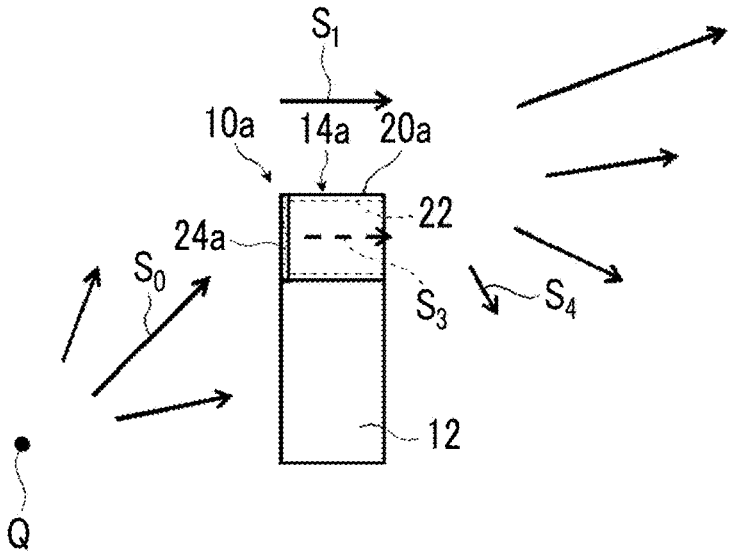
FIG. 8 is a diagram conceptually showing the propagation of sound waves in the case of the soundproof structure of the present invention.

Therefore, as shown in FIG. 8, in the soundproof structure 10*a*, among sounds $S_0$ generated from the sound source Q, a sound $S_1$ passing through the upper portion of the soundproof structure 10*a* and a sound $S_3$ passing through the film vibration of the film 24*a* of the soundproof unit 14*a* have different phases. For this reason, since the sound $S_1$ and the sound $S_3$ interfere with each other to become weak (canceled out), the sound leaking to the back side of the soundproof structure 10*a* is reduced due to the diffraction phenomenon as indicated by sound $S_4$.

As described above, using the fact that the phase of the sound passing through the soundproof unit changes, the soundproof structure according to the embodiment of the present invention insulates sound by cancellation due to the phase difference between the sound passing through the space of the upper portion of the soundproof structure and the sound passing through the soundproof unit provided in the soundproof structure. Therefore, a higher soundproofing effect can be obtained with a smaller area than in the configuration in which a sound absorbing material formed of a porous body is provided in a partition member.

In the soundproof unit, since sounds in the vicinity of the resonance frequency of the film vibration of the film are likely to pass through the film, an effect of cancellation due to the phase difference can be obtained in the vicinity of the resonance frequency of the film of the soundproof unit. In addition, sounds not in the vicinity of the resonance frequency are difficult to pass through the film (that is, the sound pressure of the transmitted sound decreases), but the amount of change in the phase increases. For this reason, the effect of cancellation due to the phase difference is obtained. Therefore, desired sound can be selectively insulated by appropriately setting the resonance frequency of the film of the soundproof unit.

In addition, since the soundproof unit can be formed by only a film that vibrates and a frame body that fixes the film, the inside of the frame body can be made hollow. Therefore, the soundproof unit can be made very lightweight.

Since porous bodies themselves generally used as sound absorbing materials, such as urethane, glass wool and rock wool, are opaque, the landscape or the design may be damaged depending on the place to be used.

In contrast, since the soundproof unit used in the soundproof structure according to the embodiment of the present invention is configured to include the film and the frame body, the soundproof unit can be made to have light transparency by using a transparent member as a material for forming the film and the frame body. This can prevent damage to the landscape and the design.

In addition, since the soundproof unit is transparent, it is possible to guide light from the outside into the space partitioned by the soundproof structure. Therefore, it is possible to secure brightness and a field of view. In addition, by making a person not feel the size, it is possible to reduce the sense of oppression.

Here, in the present invention, the transparent member is a member having a transmittance of 80% or more of light having a wavelength of 380 nm to 780 nm.

In the present invention, the transmittance may be measured according to the method of measuring the total light transmittance in JIS K 7375 "Method for calculating total light transmittance and total light reflectivity of plastics".

Since the soundproof unit used in the soundproof structure according to the embodiment of the present invention is configured to include the film and the frame body, it is possible to select a material having a desired color as a material for forming the film and the frame body or easily perform coloring. For example, by making the color of the material for forming the film and the frame body similar to the color of the partition member, it is possible to prevent damage to the landscape and the design.

In addition, since the soundproof structure according to the embodiment of the present invention shows its effect only by providing the soundproof unit in the partition member, it is possible to easily provide the soundproof unit later in the partition member, such as a known soundproof wall and partition.

Figure 9:
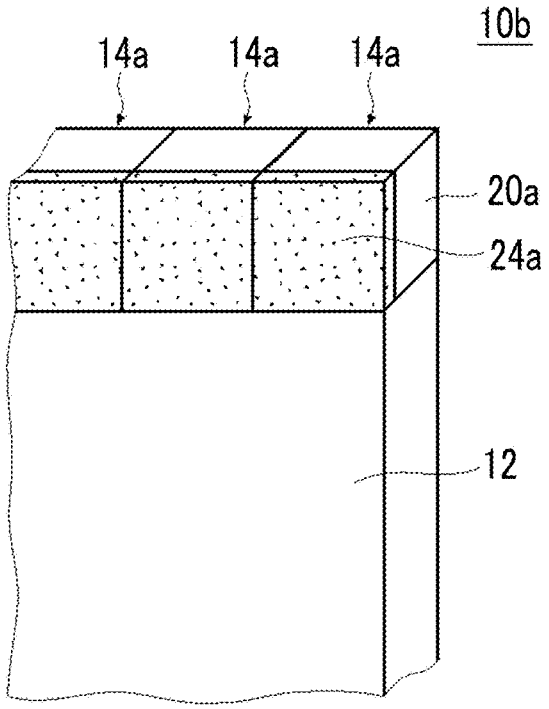
FIG. 9 is a partially enlarged perspective view schematically showing another example of the soundproof structure of the present invention.
Figure 10:
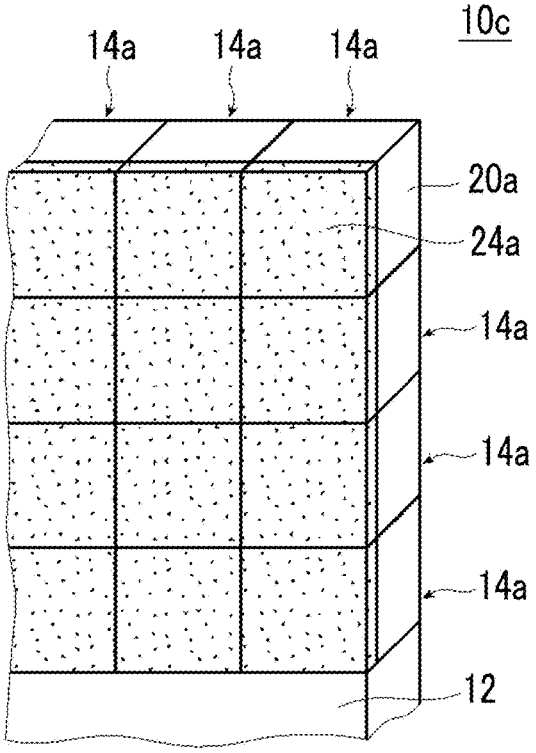
FIG. 10 is a partially enlarged perspective view schematically showing another example of the soundproof structure of the present invention.

In the example shown in FIG. 3, the two rows of soundproof units 14*a* are arranged on the upper end surface of the partition member 12, but the present invention is not limited thereto. As in a soundproof structure 10*b* shown in FIG. 9, one row of soundproof units 14*a* may be provided on the upper end surface of the partition member 12. Alternatively, a configuration having three or more rows of soundproof units 14*a* may be adopted. For example, as in a soundproof structure 10*c* shown in FIG. 10, a configuration having four or more rows of soundproof units 14*a* on the upper end surface of the partition member 12 may be adopted.

In the example shown in FIG. 3, the thickness of the soundproof unit 14*a* is set to a thickness approximately equal to the thickness of the partition member 12, but the present invention is not limited thereto. However, the thickness of the soundproof unit 14*a* and the thickness of the partition member 12 may be different.

Figure 11:
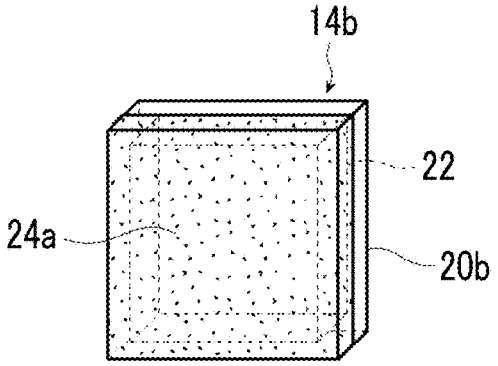
FIG. 11 is a perspective view schematically showing another example of the soundproof unit used in the soundproof structure of the present invention.
Figure 12:
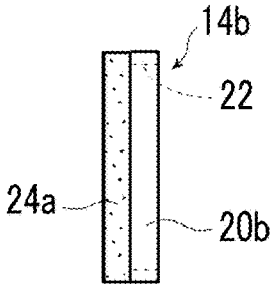
FIG. 12 is a side view of the soundproof unit shown in FIG. 11.
Figure 13:
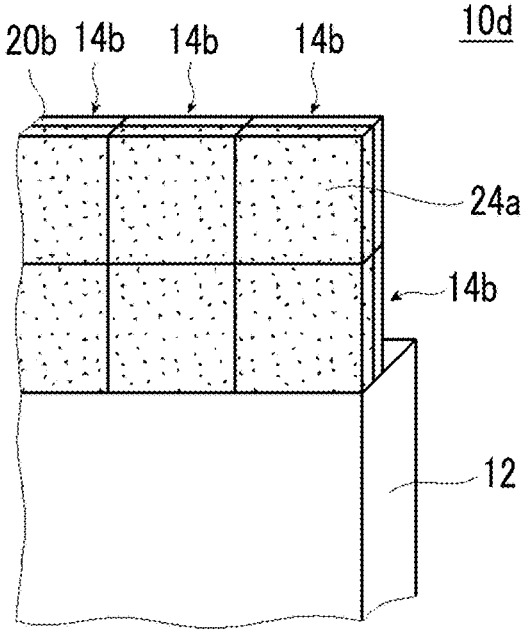
FIG. 13 is a partially enlarged perspective view schematically showing another example of the soundproof structure of the present invention.
Figure 14:
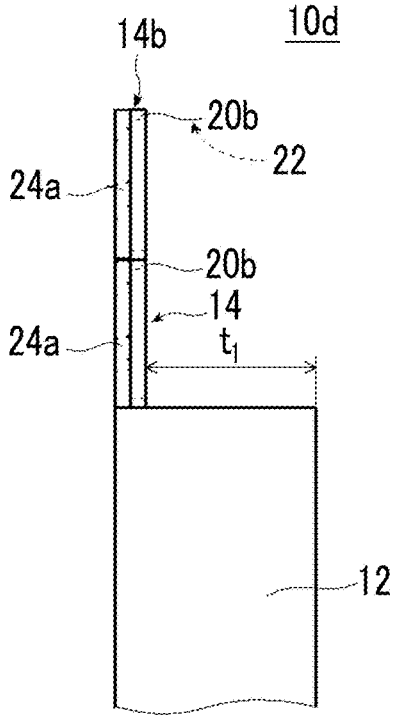
FIG. 14 is a partially enlarged side view of the soundproof structure shown in FIG. 13.

For example, by using a soundproof unit 14*b* in which the film 24*a* is vibratably fixed to a thin frame body 20*b* as shown in FIGS. 11 and 12, a configuration may be adopted in which the thickness of the soundproof unit 14*a* is smaller than the thickness of the partition member 12 as in a soundproof structure 10*d* shown in FIGS. 13 and 14. In FIG. 14, the main surface of the partition member 12 and the film surface of the film 24*a* of the soundproof unit 14*b* are even with each other, and the soundproof unit 14*b* is disposed on the partition member 12. However, the present invention is not limited thereto. A distance t 1 from one main surface of the partition member 12 to the soundproof unit 14*b* in the thickness direction is not limited, and the film surface of the film 24*a* of the soundproof unit 14*b* and the main surface of the partition member 12 may be even with each other or may not be even as long as the film surface of the film 24*a* of the soundproof unit 14*b* and the main surface of the partition member 12 are parallel.

The case where the thickness of the soundproof unit is approximately equal to the thickness of the partition member is preferable in that the installability of the soundproof unit is improved. On the other hand, in a case where the thickness of the soundproof unit is smaller than the thickness of the partition member, the weight of the soundproof unit can be further reduced.

Figure 15:
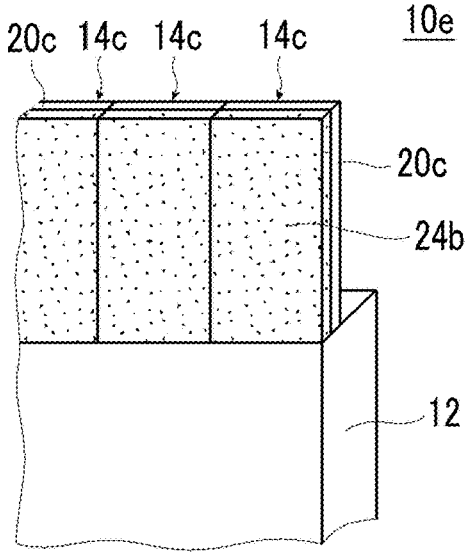
FIG. 15 is a partially enlarged perspective view schematically showing another example of the soundproof structure of the present invention.
Figure 16:
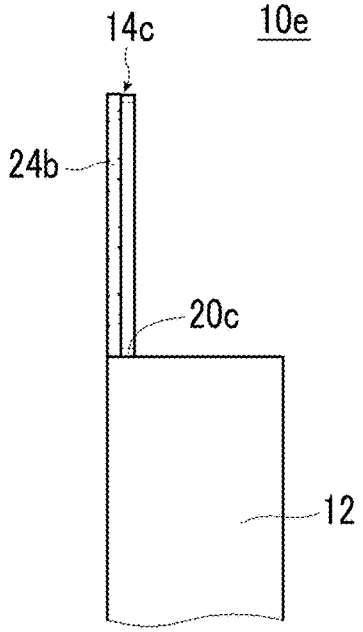
FIG. 16 is a partially enlarged side view of the soundproof structure shown in FIG. 15.

In the example shown in FIG. 13, the shape of the opening portion 22 of the soundproof unit 14*b* is an approximately square shape, but it is not limited thereto. As in a soundproof structure 10*e* shown in FIGS. 15 and 16, a soundproof unit 14*c* in which a rectangular film 24*b* is vibratably fixed to a frame body 20*c* having a rectangular opening portion may be used.

Figure 17:
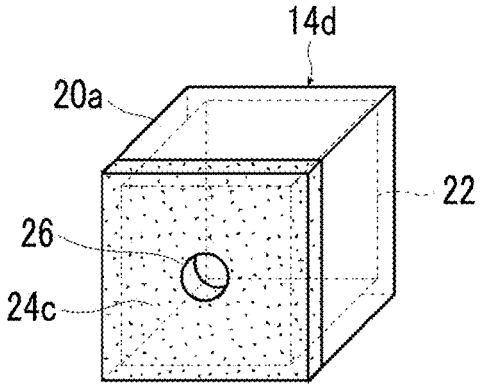
FIG. 17 is a perspective view schematically showing another example of the soundproof unit used in the soundproof structure of the present invention.
Figure 18:
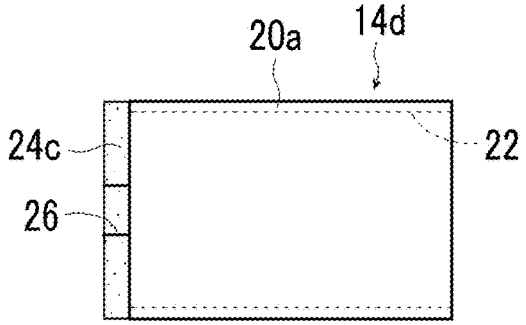
FIG. 18 is a side view of the soundproof unit shown in FIG. 17.

In a soundproof unit used in the soundproof structure according to the embodiment of the present invention, as in a soundproof unit 14*d* shown in FIGS. 17 and 18, a through-hole 26 may be formed in a film 24*c*.

Figure 19:
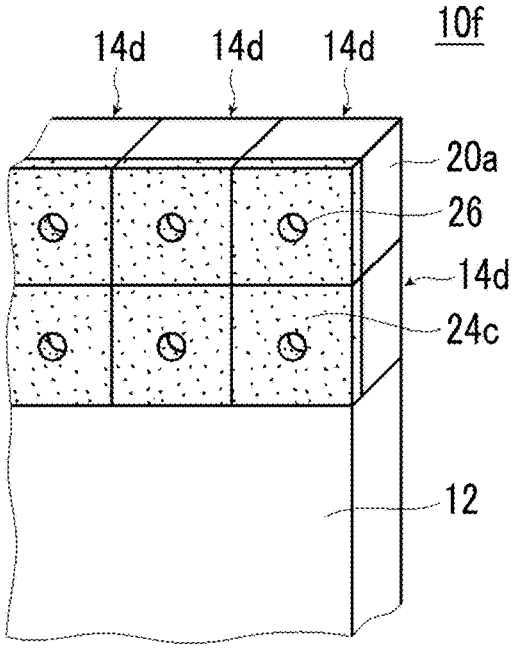
FIG. 19 is a partially enlarged perspective view schematically showing another example of the soundproof structure of the present invention.

A soundproof structure 10*f* shown in FIG. 19 has a configuration in which the soundproof unit 14*d*, which has the film 24*c* having the through-hole 26 formed therein, is arranged on the upper end surface of the partition member 12 similarly to the soundproof structure 10*a* shown in FIG. 3. As described above, even in a case where a through-hole is provided in the film, it is possible to insulate sound by generating a phase difference in the sound passing through the film vibration. A configuration having a through-hole in the film is preferable in that air permeability can be secured.

The size of the through-hole 26 is not limited, and may be set according to the size of a film 24 (the size of the opening portion 22 of the frame body 20). For example, for the film 24 having a size of 20 mm□, it is possible to provide the through-hole 26 of about φ3 mm.

Figure 20:
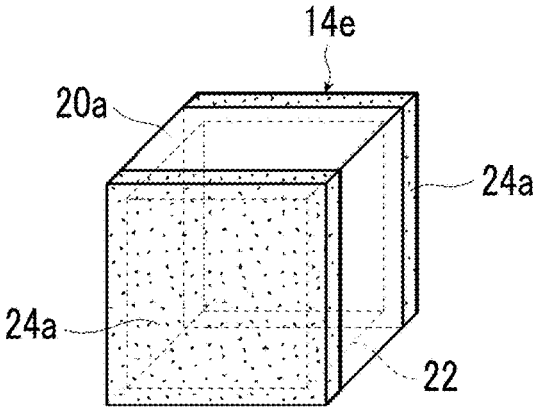
FIG. 20 is a perspective view schematically showing another example of the soundproof unit used in the soundproof structure of the present invention.

The soundproof unit used in the soundproof structure according to the embodiment of the present invention may have a configuration in which the film 24*a* is disposed on both surfaces of the opening portion 22 of the frame body 20*a* as in a soundproof unit 14*e* shown in FIG. 20.

Figure 21:
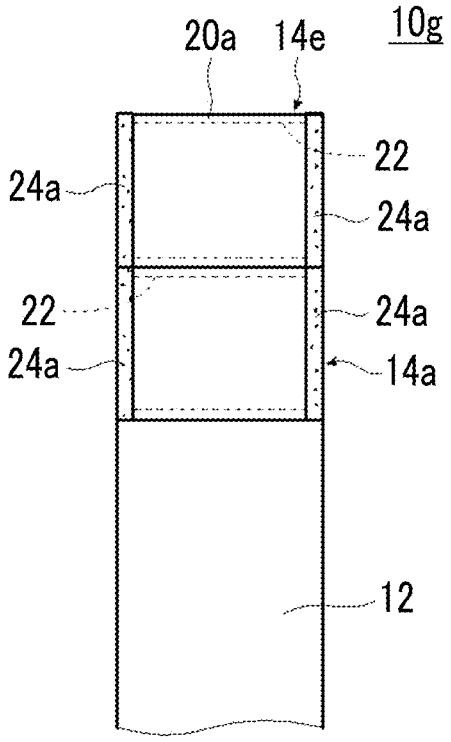
FIG. 21 is a partially enlarged perspective view schematically showing another example of the soundproof structure of the present invention.

A soundproof structure 10*g* shown in FIG. 21 has a configuration in which the soundproof unit 14*e*, which has the film 24*a* fixed to both surfaces of the frame body 20*a*, is arranged on the upper end surface of the partition member 12 similarly to the soundproof structure 10*a* shown in FIG. 3.

Figure 22:
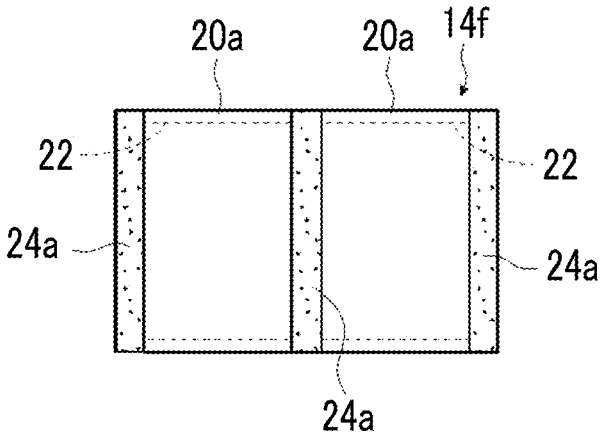
FIG. 22 is a perspective view schematically showing another example of the soundproof unit used in the soundproof structure of the present invention.

The soundproof unit used in the soundproof structure according to the embodiment of the present invention is not limited to the configuration in which the film 24*a* is vibratably fixed to the end surface of the frame body 20*a*, and a configuration may be adopted in which the film 24*a* is vibratably fixed in the opening portion 22 of the frame body 20*a* as in a soundproof unit 14*f* shown in FIG. 22. In the example shown in FIG. 22, the soundproof unit 14*f* is configured to have three films 24*a*, but the present invention is not limited thereto, and the soundproof unit 14*f* may be configured to have four or more films.

In the example shown in FIG. 3, a plurality of soundproof units having the same configuration are used. However, the present invention is not limited thereto, and a combination of soundproof units having different configurations may be used.

Figure 23:
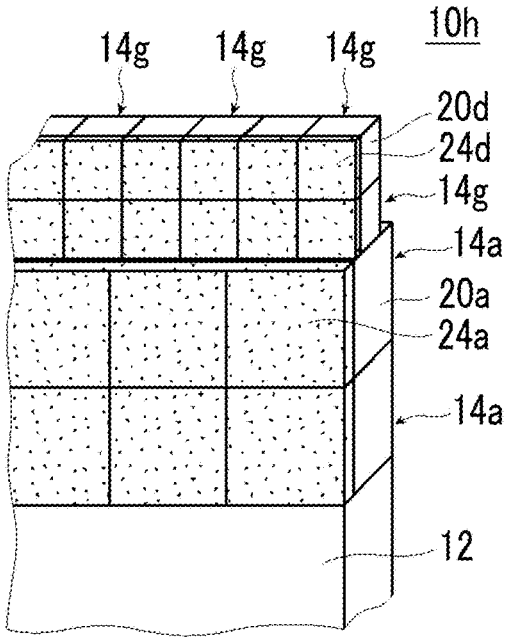
FIG. 23 is a partially enlarged perspective view schematically showing another example of the soundproof structure of the present invention.
Figure 24:
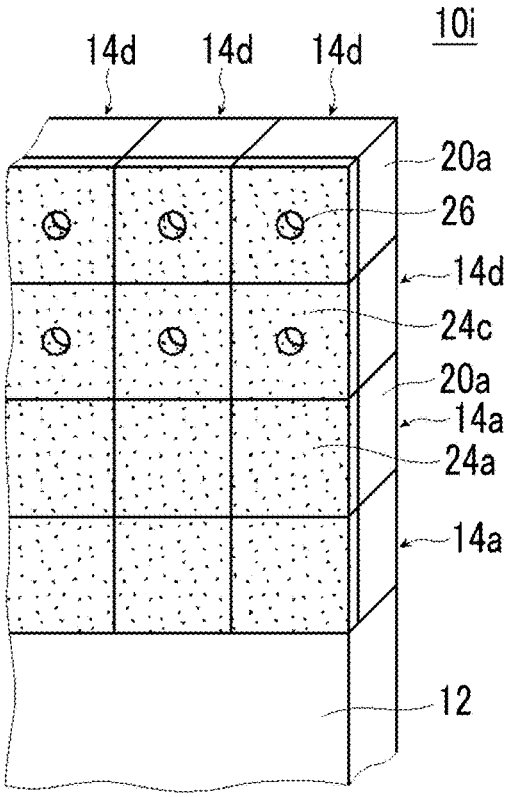
FIG. 24 is a partially enlarged perspective view schematically showing another example of the soundproof structure of the present invention.
Figure 25:
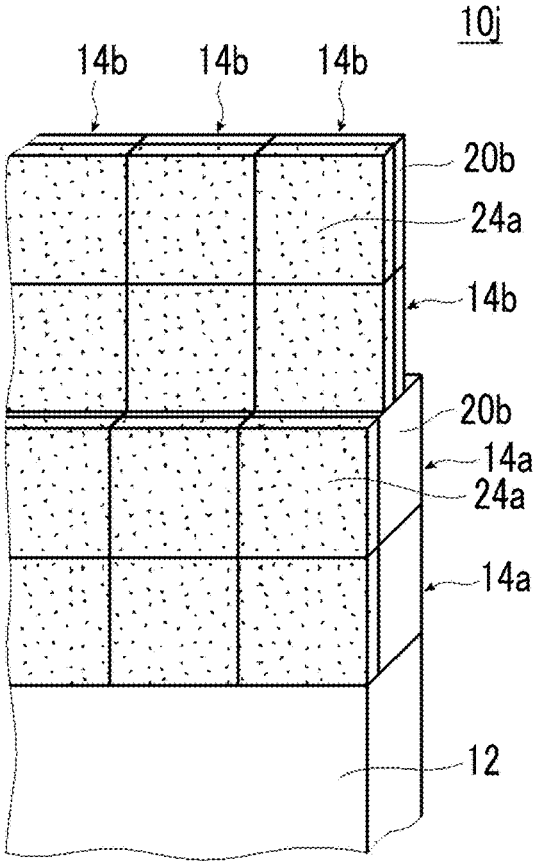
FIG. 25 is a partially enlarged perspective view schematically showing another example of the soundproof structure of the present invention.

FIGS. 23 to 25 show examples of combining soundproof units having different configurations.

A soundproof structure 10*h* shown in FIG. 23 has a soundproof unit 14*a* and a soundproof unit 14*g*. The soundproof unit 14*a* and soundproof unit 14*g* have the same configuration except that their sizes are different. That is, a frame body 20*d* (opening portion) and a film 24*d* of the soundproof unit 14*g* are smaller than the frame body 20*a* (opening portion) and the film 24*a* of the soundproof unit 14*a*.

The soundproof structure 10*h* shown in FIG. 23 has a configuration in which the two rows of soundproof units 14*a* are arranged on the upper end surface of the partition member 12 and the two rows of soundproof units 14*g* are arranged on the plurality of arranged soundproof units 14*a*.

A soundproof structure 10*i* shown in FIG. 24 has a configuration in which the two rows of soundproof units 14*a* shown in FIG. 5 are arranged on the upper end surface of the partition member 12 and the two rows of soundproof units 14*d* shown in FIG. 17 are arranged on the arranged soundproof units 14*a*.

A soundproof structure 10*j* shown in FIG. 25 has a configuration in which the two rows of soundproof units 14*a* shown in FIG. 5 are arranged on the upper end surface of the partition member 12 and the two rows of soundproof units 14*b* shown in FIG. 11 are arranged on the arranged soundproof units 14*a*.

Figure 26:
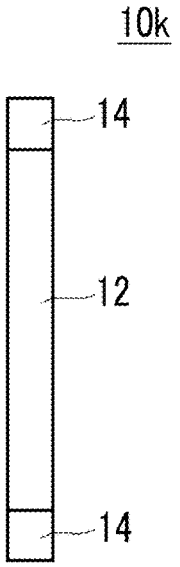
FIG. 26 is a side view schematically showing another example of the soundproof structure of the present invention.

In the soundproof structure 10*a* shown in FIGS. 1 and 2, the soundproof unit 14*a* is arranged on the upper end surface of the partition member 12. However, the present invention is not limited thereto, and the soundproof unit may be disposed on the side surface of the partition member 12 or the soundproof unit may be disposed on the lower end surface of the partition member. For example, in a case where there is a space in upper and lower portions of a partition, as in a partition (door) of a public toilet, the soundproof unit 14*a* may be arranged on each of the upper end surface and the lower end surface of the partition member 12 as in a soundproof structure 10*k* shown in FIG. 26. Alternatively, the soundproof unit 14*a* may be arranged on the entire end surfaces of the partition member 12.

The configuration in which the soundproof unit 14*a* is disposed on the end surface of the partition member 12 is not limited, and the soundproof unit 14*a* may be disposed in an opening portion serving as a window frame portion of a wall, an opening portion serving as a mounting portion of a door (door), or the like.

Figure 27:
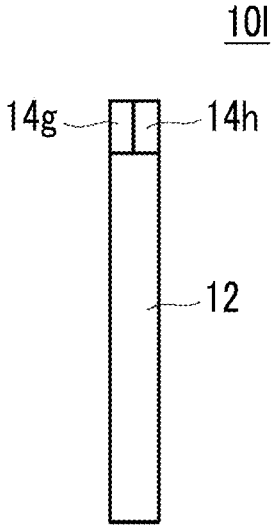
FIG. 27 is a side view schematically showing another example of the soundproof structure of the present invention.

As in a soundproof structure 10*l* shown in FIG. 27, two soundproof units (14*g* and 14*h*) may be arranged on the upper end surface of the partition member 12 so as to overlap each other in the thickness direction.

In the example shown in FIG. 1, a plurality of soundproof units may be arranged on the end surface of the partition member. However, it is sufficient that at least one soundproof unit is provided.

In the example shown in FIG. 3, the soundproof unit 14 a is disposed on the end surface of the partition member 12 with the film surface of the film 24*a* and the main surface of the partition member 12 parallel to each other. However, the present invention is not limited thereto, and the soundproof unit 14*a* may be disposed such that the film surface of the film 24*a* is inclined with respect to the main surface of the partition member 12.

The inclination of the film surface of the film 24*a* with respect to the main surface of the partition member 12 in a case where a direction parallel to an end side where the main surface of the partition member 12 and the end surface, on which the soundproof unit 14*a* is disposed, are in contact with each other is set as a rotary axis is preferably −90° to 90°, more preferably −30° to 30°.

A case where the value of the inclination is positive indicates that the film surface is inclined to the sound source side of the sound to be insulated, and a case where the value of the inclination is negative indicates that the film surface is inclined to a side opposite to the sound source.

In addition, the inclination of the film surface of the film 24*a* with respect to the main surface of the partition member 12 in a case where a direction perpendicular to the end side where the main surface of the partition member 12 and the end surface, on which the soundproof unit 14*a* is disposed, are in contact with each other is set as a rotary axis is preferably −90° to 90°, more preferably −30° to 30°.

Next, each component of the soundproof unit will be described in detail.

In the following description, in a case where there is no need to distinguish in particular, the soundproof structures 10*a* to 101 are collectively referred to as a soundproof structure 10, the soundproof units 14*a* to 14*i* are collectively referred to as a soundproof unit 14, the frame bodies 20*a* to 20*d* are collectively referred to as a frame body 20, and the films 24*a* to 24*d* are collectively referred to as a film 24.

As described above, the soundproof unit 14 has the frame body 20 having the opening portion 22 passing therethrough and the film 24 disposed so as to cover one of the opening surfaces of the opening portion 22, and the film 24 vibrates according to the sound incident on the film 24.

The frame body 20 has one or more opening portions 22, and fixes the film 24 so as to cover the opening portion 22 so that the film 24 is vibratably supported.

It is preferable that the frame body 20 has a closed continuous shape so as to be able to fix and restrain the entire circumference of the film 24. However, the present invention is not limited thereto, and the frame body 20 may be partially cut to have a discontinuous shape.

The shape of the opening portion 22 of the frame body 20 is not particularly limited. For example, the shape of the opening portion 22 of the frame body 20 may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. End surfaces on both sides of the opening portion 22 of the frame body 20 are not blocked and are open to the outside as they are. That is, the opening portion 22 passes through the frame body 20.

The size of the frame body 20 is a size in a plan view, and can be defined as the size of the opening portion 22. Accordingly, in the following description, the size of the frame body 20 is the size of the opening portion 22. However, in the case of a regular polygon such as a circle or a square, the size of the frame body 20 can be defined as a distance between opposite sides passing through the center or as a circle equivalent diameter. In the case of a polygon, an ellipse, or an irregular shape, the size of the frame body 20 can be defined as a circle equivalent diameter. In the present invention, the circle equivalent diameter and the radius are a diameter and a radius at the time of conversion into circles having the same area.

The size of the opening portion 22 of the frame body 20 is not particularly limited, and may be appropriately set according to a soundproofing target to which the soundproof structure according to the embodiment of the present invention is applied for soundproofing. For example, the size of the frame body 20 (opening portion) is preferably 0.5 mm to 200 mm, more preferably 1 mm to 100 mm, and most preferably 2 mm to 30 mm.

In addition, the wall thickness and the thickness of the frame of the frame body 20 are not particularly limited as long as the film 24 can be reliably fixed so that the film 24 can be reliably supported. For example, the wall thickness and the thickness of the frame of the frame body 20 can be set according to the size of the frame body 20.

For example, in a case where the size of the frame body 20 is 0.5 mm to 50 mm, the wall thickness of the frame of the frame body 20 is preferably 0.5 mm to 20 mm, more preferably 0.7 mm to 10 mm, and most preferably 1 mm to 5 mm.

In a case where the ratio of the wall thickness of the frame body 20 to the size of the frame body 20 is too large, the area ratio of the portion of the frame body 20 with respect to the entire structure increases. Accordingly, there is a concern that the device will become heavy. On the other hand, in a case where the ratio is too small, it is difficult to strongly fix the laminate with an adhesive or the like in the frame body 20 portion.

In a case where the size of the frame body 20 exceeds 50 mm and is equal to or less than 200 mm, the wall thickness of the frame body 20 is preferably 1 mm to 100 mm, more preferably 3 mm to 50 mm, and most preferably 5 mm to 20 mm.

In addition, it is preferable that the thickness of the frame body 20, that is, the thickness of the opening portion 22 in the penetration direction is approximately equal to the thickness of the partition member 12. However, the thickness of the frame body 20, that is, the thickness of the opening portion 22 in the penetration direction is preferably 0.5 mm to 200 mm, more preferably 0.7 mm to 100 mm, and even more preferably 1 mm to 50 mm.

The material of the frame body 20 is not particularly limited as long as the material can support the film 24, has a suitable strength, and is resistant to the soundproof environment of the soundproofing target, and can be selected according to the soundproofing target and the soundproof environment. For example, as materials of the frame body 20, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideimide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, and glass fiber reinforced plastics (GFRP) can be mentioned. A plurality of materials of the frame body 20 may be used in combination.

Examples of the material of the transparent frame body 20 include a transparent resin material, a transparent inorganic material, and the like. Specific examples of the transparent resin material include acetyl cellulose based resins such as triacetyl cellulose; polyester based resins such as polyethylene terephthalate (PET) and polyethylene naphthalate; olefin based resins such as polyethylene (PE), polymethylpentene, cycloolefin polymers, and cycloolefin copolymers; acrylic based resins such as polymethyl methacrylate; and polycarbonate. On the other hand, examples of the transparent inorganic material include glass such as soda glass, potassium glass and lead glass; ceramics such as translucent piezoelectric ceramics (PLZT); quartz; and fluorite.

In a case where a transparent material is used as the frame body 20, an antireflection layer or the like may be given to the frame body 20. Accordingly, since the visibility can be made low (difficult to see), it is possible to improve the transparency.

A known sound absorbing material may be disposed in the opening portion 22 of the frame body 20.

By arranging the sound absorbing material, the sound insulation characteristics can be more suitably adjusted by the sound absorption effect of the sound absorbing material.

The sound absorbing material is not particularly limited, and various known sound absorbing materials, such as a urethane plate and a nonwoven fabric, can be used.

The film 24 is fixed so as to be restrained by the frame body 20 so that the opening portion 22 of the frame body 20 is covered, and the film 24 absorbs or reflects the energy of sound waves to insulate sound by performing vibration vibrates corresponding to the sound waves from the outside. In addition, there is an effect of shifting the phase of the sound passing through the film vibration. Therefore, it is preferable that the film 24 is impermeable to air, that is, the film is formed of an air-impermeable material.

Here, in the present invention, the air-impermeable material is a material having a flow resistance per unit thickness of 1000000 ($N \cdot s/m^4$) or more.

Incidentally, since the film 24 needs to vibrate with the frame body 20 as a node, it is necessary for the film 24 to be fixed to the frame body 20 so as to be reliably restrained by the frame body 20 and accordingly become an antinode of film vibration. For this reason, it is preferable that the film 24 is formed of a flexible viscoelastic material.

Therefore, the shape of the film 24 can be the shape of the opening portion 22 of the frame body 20. In addition, the size of the film 24 can be the size of the frame body 20, more specifically, the size of the opening portion 22 of the frame body 20.

Here, the film 24 fixed to the frame body 20 of the soundproof unit 14 has a first natural vibration frequency at which the transmission loss is the minimum, for example 0 dB, as a resonance frequency that is a frequency of the lowest order natural vibration mode. The first natural vibration frequency is determined by a structure configured to include the frame body 20 and the film 24. Therefore, the present inventors have found that approximately the same value as in a case where the through-hole 26 is not present is obtained even in a case where the through-hole 26 is perforated in the film 24 as in the soundproof unit 14*d* shown in FIG. 17.

Here, the first natural vibration frequency of the film 24, which is fixed so as to be restrained by the frame body 20, in the structure configured to include the frame body 20 and the film 24 is a frequency of the natural vibration mode, in which sound waves are largely transmitted at the frequency in a case where the sound waves cause film vibration most due to the resonance phenomenon.

Here, as described above, in the soundproof structure 10 according to the embodiment of the present invention, since the phase of the sound passing through the soundproof unit 14 changes, the soundproofing effect is obtained by the effect of cancellation due to interference with the sound passing around the soundproof structure 10.

For this reason, in the soundproof unit 14, since the transmittance of the sound increases at the first natural vibration frequency of the film 24, the soundproofing effect due to cancellation of the phase-shifted sound in the vicinity of the first natural vibration frequency of the film 24 is increased.

Therefore, the first natural vibration frequency of the film 24 fixed so as to be restrained by the frame body 20 is preferably 20000 Hz or less, more preferably within the audible range (20 Hz to 20000 Hz), even more preferably in the range of 40 Hz to 16000 Hz, and particularly preferably in the range of 100 Hz to 12000 Hz.

In addition, by appropriately setting the first natural vibration frequency of the film 24 of the soundproof unit 14, the soundproof structure 10 according to the embodiment of the present invention can selectively insulate sound in a predetermined frequency band having the first natural vibration frequency as a reference.

In addition, by combining a plurality of soundproof units having different first natural vibration frequencies of the films 24, it is also possible to insulate sound in a broad band.

In order to set the first natural vibration frequency of the film 24 to a certain frequency within the audible range in the soundproof unit 14 configured to include the frame body 20 and the film 24, the thickness and the material (Young's modulus) of the film 24, the size of the frame body 20 (opening portion 22), and the like may be appropriately set.

The thickness of the film 24 is not particularly limited as long as the film 24 can vibrate. In the present invention, for example, the thickness of the film 24 can be set according to the size of the frame body 20, that is, the size of the film.

For example, the thickness of the film 24 is preferably 0.005 mm (5 μm) to 5 mm, more preferably 0.007 mm (7 μm) to 2 mm, and most preferably 0.01 mm (10 μm) to 1 mm.

Here, as described above, in the soundproof structure 10, the first natural vibration frequency of the film 24 in the soundproof unit 14 configured to include the frame body 20 and the film 24 can be determined by the geometric form of the frame body 20 of the soundproof unit 14, for example, the shape and size of the frame body 20 and the stiffness of the film 24 of the soundproof unit 14, for example, the thickness and the flexibility (Young's modulus) of the film 24.

As a parameter characterizing the first natural vibration mode of the film 24, in the case of the film 24 of the same material, a ratio between the thickness (t) of the film 24 and the square of the size (a) of the frame body 20 can be used. For example, in the case of a square, a ratio $[a^2/t]$ between the size of one side and the square (t) of the size (a) of the frame body 20 can be used. In a case where the ratio $[a^2/t]$ is the same, for example, in a case where (t, a) is (50 μm, 7.5 mm) and a case where (t, a) is (200 μm, 15 mm), the first natural vibration mode is the same frequency, that is, the same first natural vibration frequency. That is, by setting the ratio $[a^2/t]$ to a predetermined value, the scale law is established. Accordingly, an appropriate size can be selected.

The Young's modulus of the film 24 is not particularly limited as long as the film 24 has elasticity capable of causing the film vibration of the film 24. For example, the Young's modulus of the film 24 can be set according to the size of the frame body 20, that is, the size of the film in the present invention.

For example, the Young's modulus of the film 24 is preferably 1000 Pa to 3000 GPa, more preferably 10000 Pa to 2000 GPa, and most preferably 1 MPa to 1000 GPa.

The density of the film 24 is not particularly limited as long as the film can vibrate. For example, the density of the film 24 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In a case where a film-shaped material or a foil-shaped material is used as a material of the film 24, the material of the film 24 is not particularly limited as long as the material has a strength in the case of being applied to the above soundproofing target and is resistant to the soundproof environment of the soundproofing target so that the film 24 can vibrate, and can be selected according to the soundproofing target, the soundproof environment, and the like. Examples of the material of the film 24 include resin materials that can be made into a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, metal materials that can be made into a foil shape such as aluminum, chromium, titanium, stainless steel, nickel, tin, niobium, tantalum, molybdenum, zirconium, gold, silver, platinum, palladium, iron, copper, and permalloy, fibrous materials such as paper and cellulose, and materials or structures capable of forming a thin structure such as a nonwoven fabric, a film containing nano-sized fiber, porous materials including thinly processed urethane or synthrate, and carbon materials processed into a thin film structure.

Examples of the material of the transparent film 24 include a transparent resin material, a transparent inorganic material, and the like. Specific examples of the transparent resin material include acetyl cellulose based resins such as triacetyl cellulose; polyester based resins such as polyethylene terephthalate (PET) and polyethylene naphthalate; olefin based resins such as polyethylene (PE), polymethylpentene, cycloolefin polymers, and cycloolefin copolymers; acrylic based resins such as polymethyl methacrylate; and polycarbonate.

In a case where a transparent material is used as the film 24, an antireflection layer or the like may be given to the film 24. Accordingly, since the visibility can be made low (difficult to see), it is possible to improve the transparency.

The method of fixing the film 24 to the frame body 20 is not particularly limited. Any method may be used as long as the film 24 can be fixed to the frame body 20 so as to serve as a node of film vibration. For example, a method using an adhesive, a method using a physical fixture, and the like can be mentioned.

In the method using an adhesive, as shown in FIG. 6, an adhesive 28 is applied onto the surface surrounding the opening portion 22 of the frame body 20 and the film 24 is placed thereon, so that the film 24 is fixed to the frame body 20 with the adhesive. Examples of the adhesive include epoxy based adhesives (Araldite and the like), cyanoacrylate based adhesives (Aron Alpha and the like), Super X (manufactured by Cemedine Co.), acrylic based adhesives, and the like. The film 24 may also be fixed to the frame body 20 using a double-sided tape.

As a method using a physical fixture, a method can be mentioned in which the film 24 disposed so as to cover the opening portion 22 of the frame body 20 is interposed between the frame body 20 and a fixing member, such as a rod, and the fixing member is fixed to the frame body 20 by using a fixture, such as a screw.

In the case of fixing the film 24 to the frame body 20, the film 24 may be tensioned and fixed, but it is preferable to fix the film 24 without tension.

Alternatively, in the case of fixing the film 24 to the frame body 20, at least a part of the end portion of the film 24 may be fixed. That is, a part may be a free end, and there may be a simple support portion without fixing. Preferably, the end portion of the film 24 is in contact with the frame body 20. It is preferable that 50% or more of the end portion (peripheral portion) of the film 24 is fixed to the frame body 20, and it is more preferable that 90% or more is fixed to the frame body 20.

The frame body 20 and the film 24 may be integrally formed of the same material.

The configuration in which the frame body 20 and the film 24 are integrated can be manufactured by simple processing, such as compression molding, injection molding, imprinting, scraping processing, and a processing method using a three-dimensional shaping (3D) printer.

Here, assuming that the total length of the thickness of the frame body 20 in the penetration direction of the opening portion 22 and the opening end correction distance is La, the first natural vibration frequency of the film is $f_1$, and the sound speed in the air is c, it is preferable to satisfy the relationship of $c/(4\ La) \leq 20000$ . . . (1), more preferable to satisfy the relationship of $c/(4\ La) \leq 2000$ . . . (2), and most preferable to satisfy the relationship of $c/(4\ La) \leq f_1$ . . . (3).

The opening end correction distance in a case where the cross-sectional shape of the opening portion is circular is approximately 0.61×opening portion radius. As is well known, the antinode of the standing wave of the sound field is located outside the opening portion by the distance of the opening end correction. In a case where the cross-sectional shape of the opening portion is not circular, the opening end correction distance can be calculated from the circle equivalent radius by regarding the cross-sectional shape as a circle having the same area.

As described above, since sounds having frequencies apart from the first natural vibration frequency of the film are hard to pass through the film, it is difficult to obtain the effect of cancellation due to the phase difference between the sound passing through the space of the upper portion of the soundproof structure and the sound passing through the film.

Here, in the frame body 20 having the opening portion 22, air column resonance occurs in opening portion 22 according to the thickness of the frame body 20 (thickness in the penetration direction of the opening portion 22). Since the sound in the vicinity of the resonance frequency of air column resonance in the opening portion 22 resonates in the opening portion 22, the sound pressure of the sound passing through the film increases in the vicinity of the resonance frequency of air column resonance. For this reason, in the vicinity of the resonance frequency of air column resonance, it is possible to appropriately obtain the effect of cancellation due to the phase difference between the sound passing through the space of the upper portion of the soundproof structure and the sound passing through the film. Therefore, even in a frequency band apart from the first natural vibration frequency of the film, the effect of cancellation due to the phase difference can be appropriately obtained by using the air column resonance of the opening portion 22.

From the viewpoint that the resonance frequency of air column resonance is in the audible range, that is, from the viewpoint of insulating sounds in the audible range, it is preferable to satisfy the above-described Expression (1). From the viewpoint of insulating sounds with frequencies easy for human ears to hear (high sensitivity), it is preferable to satisfy Expression (2) or it is preferable to satisfy Expression (3).

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a building material, flame retardancy is required.

Therefore, the film is preferably flame retardant. In a case where a resin is used as a film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

In addition, flame retardancy can be also given by using a metal material, such as aluminum.

The frame body is also preferably a flame-retardant material. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the film to the frame body, a bonding method using a flame-retardant adhesive (Three Bond 1537 series (manufactured by Three Bond Co. Ltd.)) or solder or a mechanical fixing method, such as interposing a film between two frame bodies so as to be fixed therebetween, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont Film), PEN film Teonex (registered trademark) (manufactured by Teijin DuPont Film), and/or Lumirror (registered trademark) off-anneal low shrinkage type (manufactured by Toray Industries, Inc.) are preferably used. In general, it is preferable to use a metal film, such as aluminum having a smaller thermal expansion factor than a plastic material.

As the frame body, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame body, it is preferable to set the thickness to 1 μm or less so that the amount of expansion and contraction can be reduced.

[Weather Resistance and Light Resistance]

In a case where the soundproof member having the soundproof structure according to the embodiment of the present invention is disposed outdoors or in a place where light is incident, the weather resistance of the structural member becomes a problem.

Therefore, as the film, it is preferable to use a weather-resistant film, such as a special polyolefin film (ARTPLY (registered trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As the frame body, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame body, and an adhesive having high moisture resistance. Regarding water absorption and chemical resistance, it is preferable to appropriately select an appropriate film, frame body, and adhesive.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing dust adhering to the film, it is possible to remove dust by emitting sound having the resonance frequency of a film and strongly vibrating the film. The same effect can be obtained even in a case where a blower or wiping is used.

[Wind Pressure]

In a case where a strong wind hits a film, the film may be pressed to change the resonance frequency. Therefore, by covering the film with a nonwoven fabric, urethane, and/or a film, the influence of wind can be suppressed. Similarly to the above-described case of dust, it is preferable to provide a cover on the film so that wind does not hit the film directly.

[Combination of Soundproof Units]

In the case of having a plurality of soundproof units, a plurality of frame bodies may be formed by one continuous frame body. Alternatively, a plurality of soundproof units may be provided with an individual soundproof unit as a unit.

As a method of connecting a plurality of soundproof units in a case where a plurality of soundproof units are provided as units, a Magic Tape (registered trademark), a magnet, a button, a suction cup, and/or an uneven portion may be attached to a frame body so as to be combined therewith, or a plurality of soundproof units can be connected using a tape or the like.

[Attachment to and Detachment from a Partition Member]

In the soundproof structure according to the embodiment of the present invention, in order to allow the soundproof unit to be easily attached to the partition member or to be removable therefrom, an attachment and detachment mechanism formed of a magnetic material, a Magic Tape (registered trademark), a button, a suction cup, and/or an uneven portion is preferably attached to the end surfaces of the soundproof unit and the partition member.

[Mechanical Strength of Frame]

In the soundproof structure according to the embodiment of the present invention, since the soundproof unit is disposed on the end surface of the partition member, it is preferable that the soundproof unit (frame body) is lightweight. In a case where the weight is reduced simply by making the frame of the frame body thin, the stiffness of the frame body is reduced so that the frame body itself easily vibrates. As a result, a function as a fixed end is degraded.

Therefore, in order to reduce the increase in mass while maintaining high stiffness, it is preferable to form a hole or a groove in the frame body. For example, by using a truss structure, a Rahmem structure, and the like, it is possible to achieve both high stiffness and light weight.

As described above, the soundproof structure according to the embodiment of the present invention is used for soundproof walls on highways, general roads, railroad tracks, and the like, doors and walls of buildings, doors of toilets, partitions used in offices and conference rooms, and the like. Alternatively, by providing the soundproof structure on the porch or providing the soundproof structure between the counter kitchen and the living room, silence can be realized in the living space where silence is required.

EXAMPLES

Hereinafter, the present invention will be described in more detail by way of examples. Materials, the amount of use, ratios, treatment content, treatment procedures, and the like shown in the following examples can be appropriately changed without departing from the gist of the present invention. Therefore, the range of the present invention should not be interpreted restrictively by the following examples.

Example 1-1

<Manufacturing of a Soundproof Unit>

As the frame body 20, an acrylic frame body having a size of the opening portion 22 of 40 mm□, a frame width of 5 mm, and a frame thickness of 20 mm was manufactured.

A PET film (Lumirror; manufactured by Toray Industries, Inc.) having a thickness of 50 μm was attached to the opening surface of the frame body 20 with a double-sided tape (Scotch manufactured by 3M Co., Ltd.) to manufacture the soundproof unit 14 shown in FIG. 13.

The first natural vibration frequency of the film 24 of the soundproof unit 14 was measured, and was lower than 100 Hz.

<Manufacturing of a Soundproof Structure>

As the partition member 12, a plate-shaped member having a thickness of 50 mm and a width of 0.350 m and formed of a material of stainless steel was used.

On the upper end surface of the partition member 12, two soundproof units 14 were disposed in the height direction and seven soundproof units 14 were disposed in the width direction to manufacture the soundproof structure 10 shown in FIG. 13.

The height of the soundproof structure 10 including the soundproof unit 14 was 0.5 m.

Example 1-2

A soundproof structure was manufactured in the same manner as in Example 1-1 except that the thickness of the film was set to 125 μm.

The first natural vibration frequency of the film of the soundproof unit was 250 Hz.

Example 1-3

A soundproof structure was manufactured in the same manner as in Example 1-1 except that the thickness of the film was set to 250 μm.

The first natural vibration frequency of the film of the soundproof unit was 500 Hz.

Comparative Example 1-1

A soundproof structure was manufactured in the same manner as in Example 1-1 except that there was no soundproof unit. That is, a single partition member is referred to as Comparative example 1-1. Therefore, the height of the partition member was 0.5 m.

Comparative Example 1-2

Figure 36:
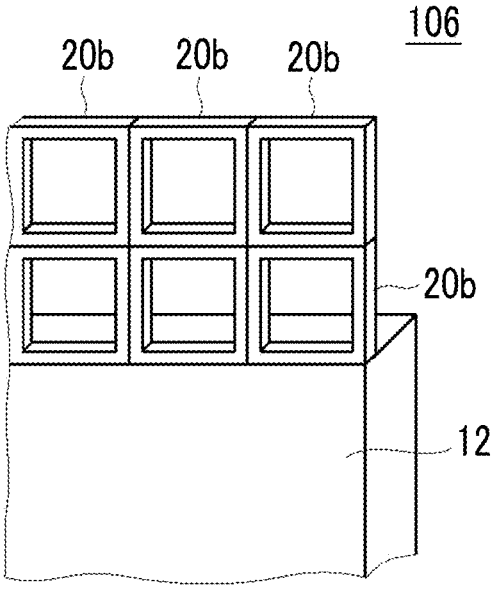
FIG. 36 is a partially enlarged perspective view showing a soundproof structure of a comparative example.

A soundproof structure was manufactured in the same manner as in Example 1-1 except that there was no film, as in a soundproof structure 106 shown in FIG. 36. The soundproof structure 106 shown in FIG. 36 has a configuration in which the frame bodies 20*b* are arranged on the upper end surface of the partition member 12.

Comparative Example 1-3

Figure 37:
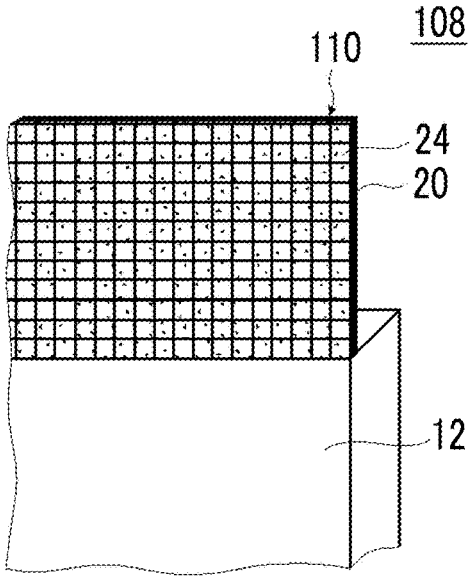
FIG. 37 is a partially enlarged perspective view showing a soundproof structure of a comparative example.

A soundproof structure was manufactured in the same manner as in Example 1-1 except that a soundproof unit 110, in which the opening portion of the frame body 20 is small and the first natural vibration frequency of the film 24 is outside the audible range, is used, as in a soundproof structure 108 shown in FIG. 37. Specifically, the size of the opening portion of the frame body 20 is 2 mm and the frame width is 1 mm. On the upper end surface of the partition member 12, 40 soundproof units 110 are disposed in the height direction and 140 soundproof units 110 are disposed in the width direction. The first natural vibration frequency of the film 24 of the soundproof unit 110 was over 20000 Hz.

Comparative Example 1-4

A soundproof structure was manufactured in the same manner as in Comparative example 1-3 except that the material of the film was stainless steel and the thickness was 1000 μm.

The film can be regarded as a rigid body and does not vibrate.

[Evaluation]

<Insertion Loss Difference>

The soundproofing effect was evaluated by calculating the insertion loss difference in a case where each soundproof structure was used.

Figure 28:
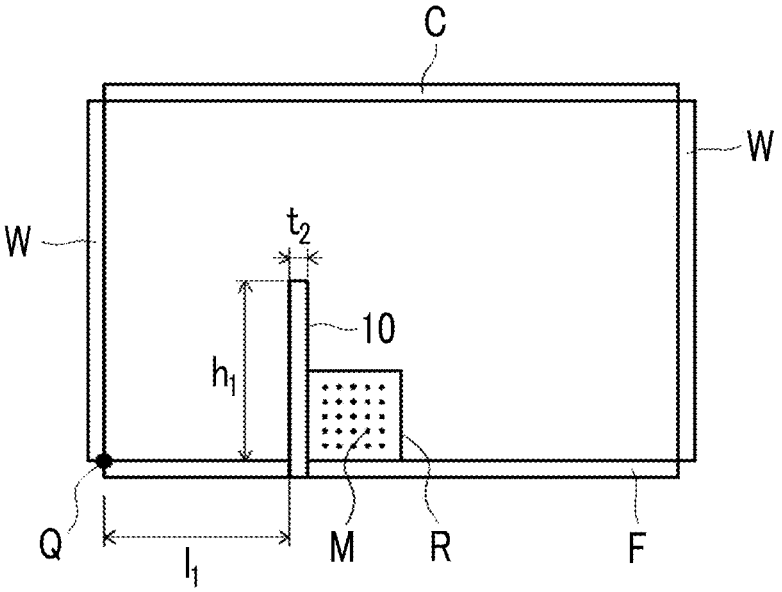
FIG. 28 is a diagram illustrating a method of measuring the sound pressure distribution.

Specifically, as shown in FIG. 28, a measurement space surrounded by an acrylic floor F, a wall surface W on which a sound absorbing body formed of urethane was entirely provided, and a ceiling C on which a sound absorbing body formed of urethane was entirely provided was prepared. The height of the measurement space was 1 m, the depth (length in the horizontal direction in the diagram) was 1.5 m, and the width (length in a direction perpendicular to the paper surface) was 0.350 m.

A speaker Q (FE103En, manufactured by FOSTEX Co., Ltd.) was disposed as a sound source on the floor F on one side of the wall W at the center in the width direction of the measurement space, and the soundproof structure 10 was provided at a position 0.5 m away from the speaker Q in the depth direction. Assuming that a region of 0.25 m×0.25 m on the surface side of the soundproof structure 10 opposite to the speaker Q is a measurement region R, 5×5 microphones M (type 4160N, manufactured by Accor, Inc.) were provided at a distance of 41.7 mm in the measurement region R, and the sound pressure in the measurement region R was measured by the microphones M.

Assuming that the average value of the sound pressure measured by 25 microphones M in a state in which the soundproof structure 10 is not provided is $P_0$ and the average value of the sound pressure measured by 25 microphones M in a state in which the soundproof structure 10 is provided is P1, an insertion loss L is defined by the following equation.

$$L=20\times\log(|P0|/|P1|)$$

A difference Lx−L0 between the insertion loss Lx in each example and each comparative example and the insertion loss $L_0$ in Comparative example 1-1, which was a single partition member, was calculated as an insertion loss difference ΔL. The fact that the value of the insertion loss difference ΔL is positive indicates that the soundproofing effect is higher than that of the single partition member, and the fact that the value of the insertion loss difference ΔL is negative indicates that the soundproofing effect is lower than that of the single partition member.

The result is shown in Table 1. Table 1 shows the insertion loss difference at 1600 Hz.

TABLE 1

| | | Frame body | | Film | | | |
|---|---|---|---|---|---|---|---|
| | Configuration of soundproof unit | Opening portion size | Thickness mm | Material | Thickness μm | First natural vibration frequency Hz | Insertion loss difference @1600 Hz dB |
| Example 1-1 | Frame body + film | 40 mm□ | 20 | PET | 50 | Lower than 100 | 18.5 |
| Example 1-2 | Frame body + film | 40 mm□ | 20 | PET | 125 | 250 | 4.3 |
| Example 1-3 | Frame body + film | 40 mm□ | 20 | PET | 250 | 500 | 0.4 |
| Comparative Example 1-1 | None | — | — | — | — | — | 0 |
| Comparative Example 1-2 | Frame body | 40 mm□ | 20 | — | — | — | −1.9 |
| Comparative Example 1-3 | Frame body + film | 2 mm□ | 20 | PET | 50 | Exceeding 20000 | −1.1 |
| Comparative Example 1-4 | Frame body + rigid body | 2 mm□ | 20 | stainless | 1000 | — | −1.2 |

As shown in Table 1, it can be seen that the insertion loss difference ΔL in Examples 1-1 to 1-3 is higher than that in the comparative example and accordingly the soundproofing effect is high.

Example 1-4

A soundproof structure 10 was manufactured in the same manner as in Example 1-2 except that the thickness of the frame body 20 was set to 50 mm, and the insertion loss difference was measured.

Examples 1-5 to 1-9

A soundproof structure 10 was manufactured in the same manner as in Example 1-4 except that the material and the thickness of the film were changed as shown in Table 2, and the insertion loss difference was measured.

The result is shown in Table 2.

TABLE 2

| | | Frame body | | Film | | | |
|---|---|---|---|---|---|---|---|
| | Configuration of soundproof unit | Opening portion size | Thickness mm | Material | Thickness μm | First natural vibration frequency Hz | Insertion loss difference @1600 Hz dB |
| Example 1-4 | Frame body + film | 40 mm□ | 50 | PET | 125 | 250 | 4.3 |
| Example 1-5 | Frame body + film | 40 mm□ | 50 | PET | 250 | 500 | 10.4 |
| Example 1-6 | Frame body + film | 40 mm□ | 50 | PET | 1000 | 1950 | 8.5 |
| Example 1-7 | Frame body + film | 40 mm□ | 50 | Silicone rubber | 100 | Lower than 100 | 1.5 |
| Example 1-8 | Frame body + film | 40 mm□ | 50 | Silicone rubber | 500 | Lower than 100 | 15.6 |
| Example 1-9 | Frame body + film | 40 mm□ | 50 | Silicone rubber | 1000 | Lower than 100 | 13.7 |

As shown in Table 2, it can be seen that the insertion loss difference ΔL in Examples 1-4 to 1-9 of the present invention is positive values and accordingly the soundproofing effect is high.

Example 1-10

A soundproof structure was manufactured in the same manner as in Example 1-4 except that the material of the film was polyimide and the thickness of the film was 100 μm.

The first natural vibration frequency of the film of the soundproof unit was 200 Hz.

Example 1-11

A soundproof structure was manufactured in the same manner as in Example 1-10 except that the thickness of the film was set to 200 μm.

The first natural vibration frequency of the film of the soundproof unit was 340 Hz.

The result is shown in Table 3. Table 3 shows the insertion loss difference at 2000 Hz.

TABLE 3

| | | Frame body | | Film | | | |
|---|---|---|---|---|---|---|---|
| | Configuration of soundproof unit | Opening portion size | Thickness mm | Material | Thickness μm | First natural vibration frequency Hz | Insertion loss difference @2000 Hz dB |
| Example 1-10 | Frame body + film | 40 mm□ | 50 | polyimide | 100 | 200 | 7.5 |
| Example 1-11 | Frame body + film | 40 mm□ | 50 | Polyimide | 200 | 340 | 11.8 |

Comparative Example 1-5

A soundproof structure was manufactured in the same manner as in Example 1-1 except that, instead of the soundproof unit, Glass Wool (GW64 manufactured by Asahi Glass Fiber Co., Ltd., thickness: 50 mm) as a fibrous porous sound absorbing material was disposed on the upper end surface of the partition member, and the insertion loss difference was measured.

Figure 29:
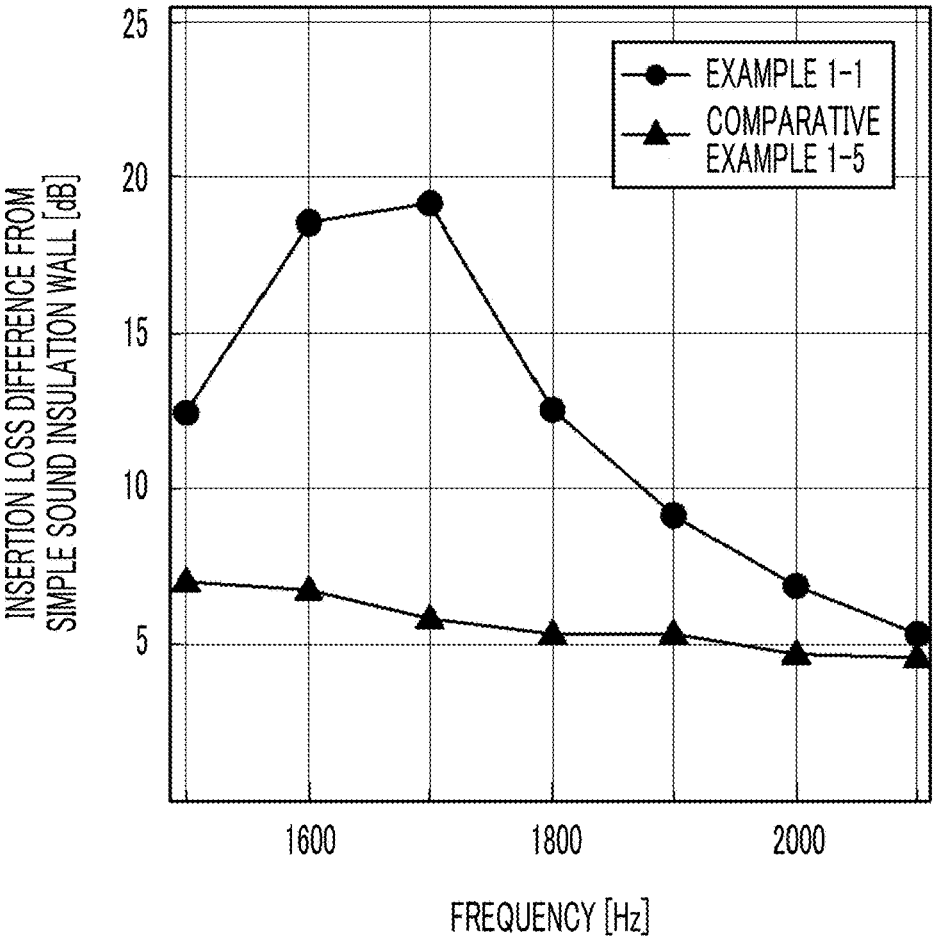
FIG. 29 is a graph showing the relationship between the frequency and the insertion loss difference.

FIG. 29 is a graph showing the relationship between the insertion loss difference and the frequency in Example 1-1 and Comparative example 1-5.

As can be seen from FIG. 29, it can be seen that Example 1-1 of the present invention has a higher soundproofing effect in a broad band than in the conventional structure.

Examples 2-1 and 2-2

A soundproof structure 10 was manufactured in the same manner as in Example 1-1 except that the number of soundproof units 14 in the height direction was set to 1 and 4, and the insertion loss difference was measured.

The result is shown in Table 4. In Table 4, the insertion loss difference at 1600 Hz is shown for Example 1-1 and the insertion loss difference at 2000 Hz is shown for Examples 2-1 and 2-2. This frequency is a frequency at which the insertion loss difference in each example is the largest.

TABLE 4

| | Soundproof unit | | Frame body | | Film | | | Insertion loss |
|---|---|---|---|---|---|---|---|---|
| | Configuration | Number in height direction | Opening portion size | Thickness mm | Material | Thickness μm | First natural vibration frequency Hz | difference @1600 Hz or @2000 Hz dB |
| Example 1-1 | Frame body + film | 2 | 40 mm□ | 20 | PET | 50 | Lower than 100 | 18.5 |
| Example 2-1 | Frame body + film | 1 | 40 mm□ | 20 | PET | 50 | Lower than 100 | 5.3 |
| Example 2-2 | Frame body + film | 4 | 40 mm□ | 20 | PET | 50 | Lower than 100 | 6.3 |

As shown in Table 4, it can be seen that, by arranging a plurality of soundproof units, the insertion loss difference ΔL is higher than that in a case where there is one soundproof unit and accordingly the soundproofing effect is high.

Example 3

A soundproof structure 10 was manufactured in the same manner as in Example 1-5 except that the soundproof unit 14 shown in FIG. 20 having a configuration in which the film 24 was fixed to both surfaces of the frame body 20 was used as the soundproof unit 14, and the insertion loss difference was measured.

The insertion loss difference at a frequency of 2000 Hz was 5.3. Therefore, it can be seen that the soundproofing effect is high.

Examples 4-1 to 4-3

A soundproof structure 10 was manufactured in the same manner as in Example 1-1 except that the through-hole 26 having a diameter shown in Table 5 was formed at the center of the film 24, and the insertion loss difference was measured.

The result is shown in Table 5.

TABLE 5

| | | Frame body | | Film | | | | |
|---|---|---|---|---|---|---|---|---|
| | Configuration of soundproof unit | Opening portion size | Thickness mm | Material | Thickness μm | Through-hole diameter mm | First natural vibration frequency Hz | Insertion loss difference @1600 Hz dB |
| Example 4-1 | Frame body + film | 40 mm□ | 20 | PET | 50 | 2 | Lower than 100 | 17.6 |
| Example 4-2 | Frame body + film | 40 mm□ | 20 | PET | 50 | 3 | Lower than 100 | 16.1 |
| Example 4-3 | Frame body + film | 40 mm□ | 20 | PET | 50 | 6 | Lower than 100 | 12.6 |

As shown in Table 5, it can be seen that the insertion loss difference ΔL is high and the soundproofing effect is high even in the case of a soundproof unit in which a through-hole is formed in the film. In addition, by having a through-hole, air permeability can be secured.

Example 5-1

A soundproof structure 10 was manufactured in the same manner as in Example 2-2 except that the height of the partition member 12 was increased to set the height of the soundproof structure 10 including the soundproof unit 14 to 1 m, and the insertion loss was measured.

In this example, the height of the measurement space at the time of measuring the insertion loss was set to 2 m, and the size of the measurement region was set to 0.5 m×0.5 m.

In addition, the insertion loss difference ΔL was calculated as a difference from the insertion loss in Comparative example 5-1.

Comparative Example 5-1

A soundproof structure was manufactured in the same manner as in Example 5-1 except that the height of the partition member was set to 1 m by providing no soundproof unit 14, and the insertion loss was measured.

Example 5-2

A soundproof structure 10 was manufactured in the same manner as in Example 2-2 except that the height of the partition member 12 was increased to set the height of the soundproof structure 10 including the soundproof unit 14 to 2 m, and the insertion loss was measured.

The height of the measurement space at the time of measuring the insertion loss was set to 3 m, the distance from the sound source was set to 1 m, and the size of the measurement region was set to 1.5 m×1.5 m.

In addition, the insertion loss difference ΔL was calculated as a difference from the insertion loss in Comparative example 5-2.

Comparative Example 5-2

A soundproof structure was manufactured in the same manner as in Example 5-2 except that the height of the partition member was set to 2 m by providing no soundproof unit 14, and the insertion loss was measured.

The result is shown in Table 6.

TABLE 6

| | | Frame body | | Film | | | |
|---|---|---|---|---|---|---|---|
| | Configuration of soundproof unit | Opening portion size | Thickness mm | Material | Thickness μm | First natural vibration frequency Hz | Insertion loss difference @1600Hz dB |
| Example 5-1 | Frame body + film | 40 mm□ | 20 | PET | 50 | Lower than 100 | 12.6 |
| Comparative Example 5-1 | None | — | — | — | — | — | 0 |

TABLE 6-continued

| | | Frame body | | Film | | | |
|---|---|---|---|---|---|---|---|
| | Configuration of soundproof unit | Opening portion size | Thickness mm | Material | Thickness μm | First natural vibration frequency Hz | Insertion loss difference @1600Hz dB |
| Example 5-2 | Frame body + film | 40 mm□ | 20 | PET | 50 | Lower than 100 | 13.0 |
| Comparative Example 5-2 | None | — | — | — | — | — | 0 |

As shown in Table 6, it can be seen that, even in a case where the partition member is made high, the soundproof unit works effectively so that the insertion loss difference ΔL increases and a good soundproofing effect is obtained.

Example 6-1

A soundproof structure was manufactured in the same manner as in Example 1-1 except that the soundproof unit 14 was disposed by inclining the film surface of the film 24 by −30° with respect to the main surface of the partition member 12 (refer to FIG. 42), the insertion loss was measured, and the insertion loss difference from Comparative example 1-1 was measured.

Example 6-2

A soundproof structure was manufactured in the same manner as in Example 1-1 except that the soundproof unit 14 was disposed by inclining the film surface of the film 24 by 30° with respect to the main surface of the partition member 12 (refer to FIG. 43), the insertion loss was measured, and the insertion loss difference was calculated.

The result is shown in Table 7.

TABLE 7

| | | Frame body | | Film | | | | |
|---|---|---|---|---|---|---|---|---|
| | Configuration of soundproof unit | Opening portion size | Thickness Mm | Material | Thickness μm | First natural vibration frequency Hz | Inclination angle of film surface of soundproof unit ° | Insertion loss difference @2200 Hz dB |
| Example 6-1 | Frame body + film | 40 mm□ | 5 | PET | 50 | Lower than 100 | −30 | 14.1 |
| Example 6-2 | Frame body + film | 40 mm□ | 5 | PET | 50 | Lower than 100 | 30 | 14.2 |

As shown in Table 7, it can be seen that the insertion loss difference ΔL is high and the soundproofing effect is high even in a case where the soundproof unit is inclined.

[Simulation]

Next, in order to estimate the soundproofing performance, by simulation of acoustic structure coupling analysis using pressure sound module and structural dynamics module of COMSOL Multiphysics 5.2 that is simulation software of a finite element method, the above-described examples and comparative examples were reproduced and the sound pressure distribution was obtained by calculation. In the calculation model, the floor F and the partition member 12 were set as rigid walls. The wall surface W and the ceiling C were set as perfect matched layers (PML layer) with no sound reflection, and the four sides of the film were set as fixed ends. The frame body was a rigid body. A periodic boundary condition continuing infinitely in the width direction was adopted.

For sound pressure P obtained in such a calculation model, log(|P|) (log is a common logarithm) was calculated, and the sound pressure distribution in the measurement space was obtained.

Figure 30:
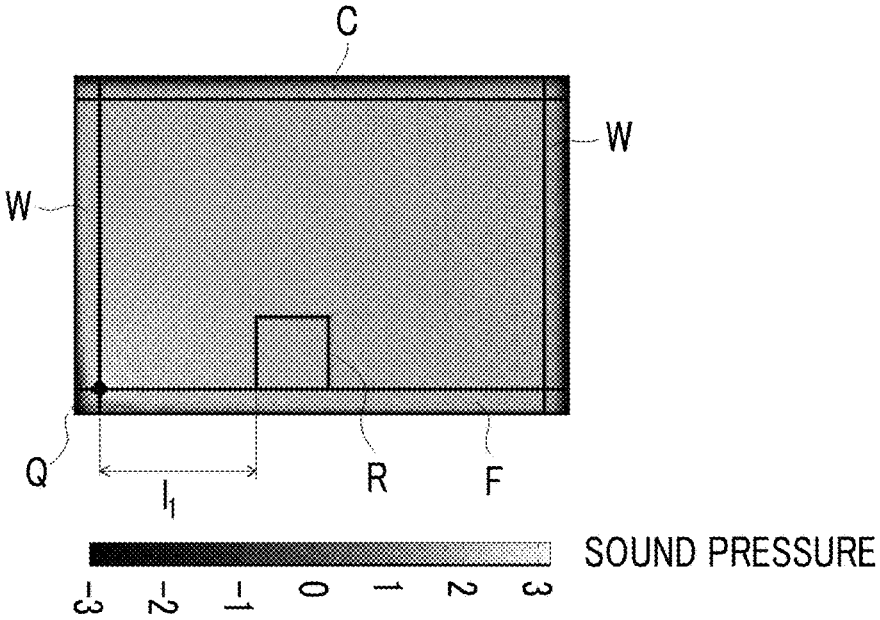
FIG. 30 is a diagram showing the calculation result of sound pressure distribution.

FIG. 30 shows a sound pressure distribution in a case where no soundproof structure is provided.

Figure 31:
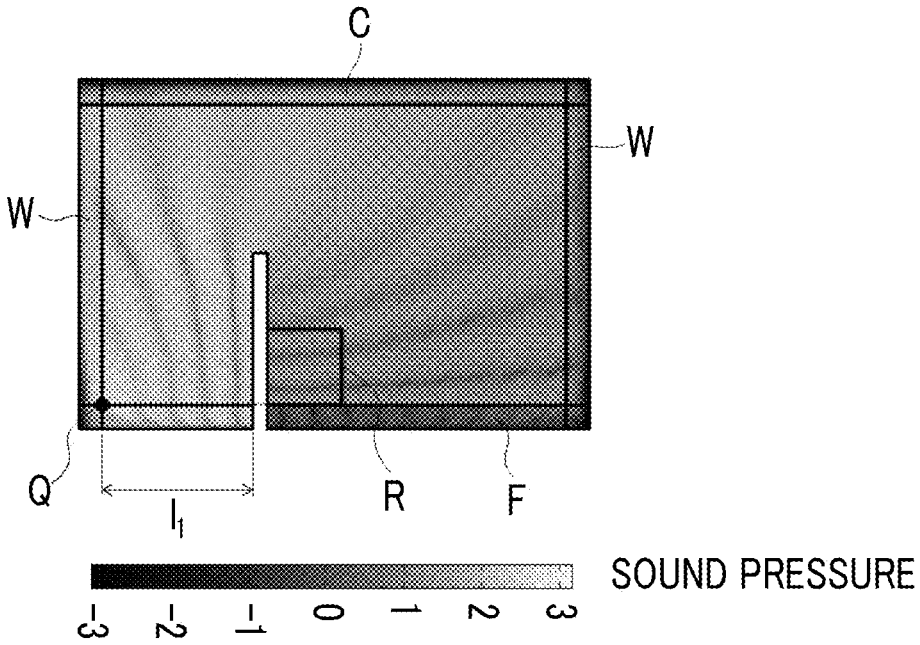
FIG. 31 is a diagram showing the calculation result of sound pressure distribution.

FIG. 31 shows a sound pressure distribution in the case of Comparative example 1-1.

Figure 32:
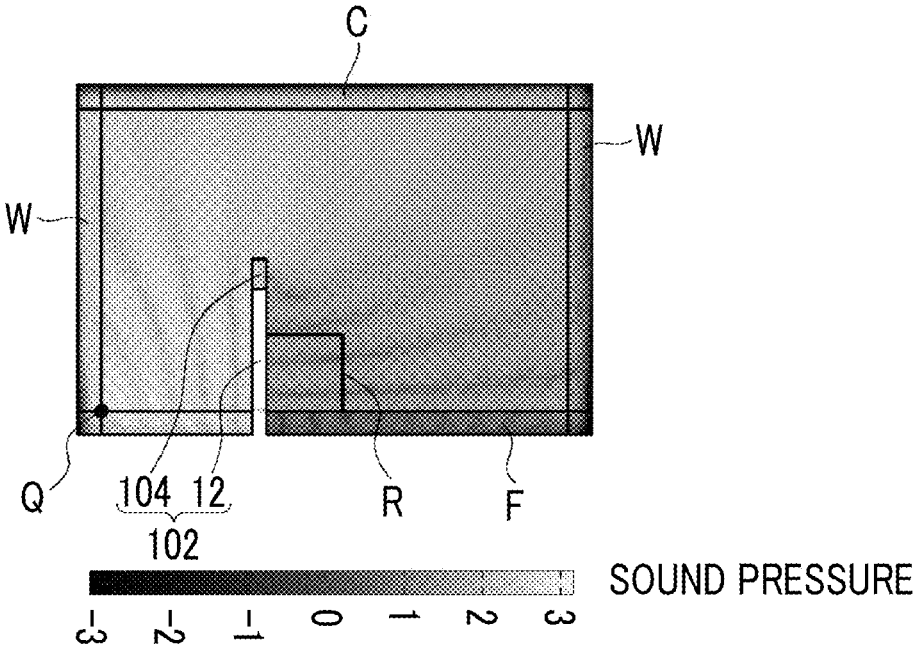
FIG. 32 is a diagram showing the calculation result of sound pressure distribution.

FIG. 32 shows a sound pressure distribution in the case of Comparative example 1-5.

Figure 33:
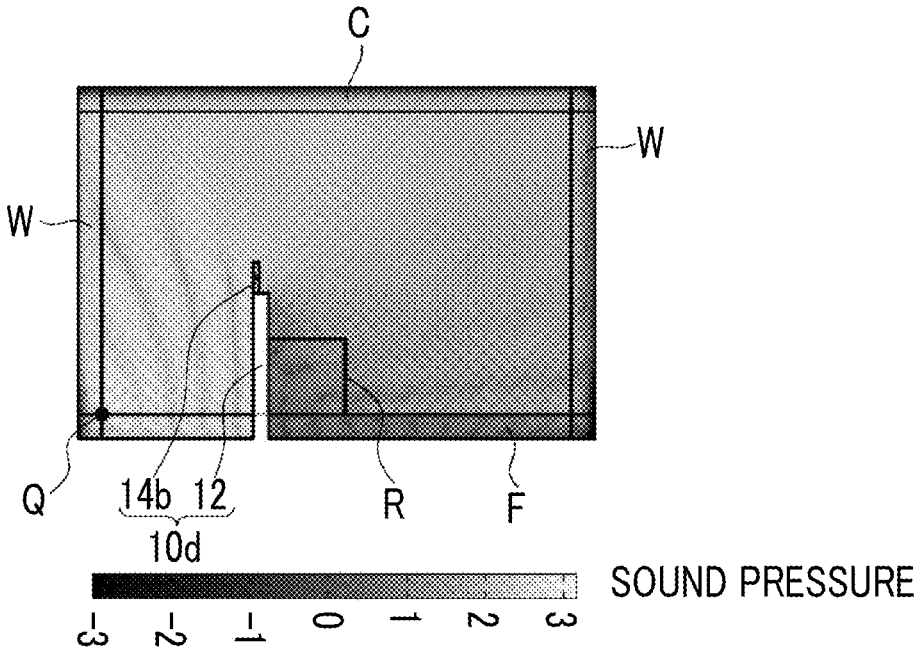
FIG. 33 is a diagram showing the calculation result of sound pressure distribution.

FIG. 33 shows a sound pressure distribution in the case of Example 1-1.

Figure 34:
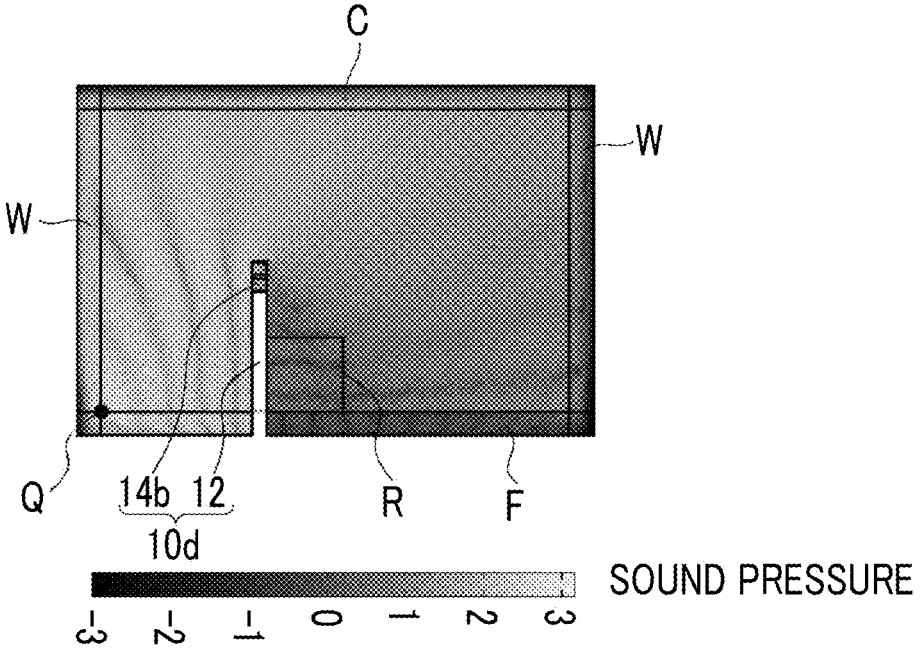
FIG. 34 is a diagram showing the calculation result of sound pressure distribution.

FIG. 34 shows a sound pressure distribution in the case of Example 1-8.

Figure 35:
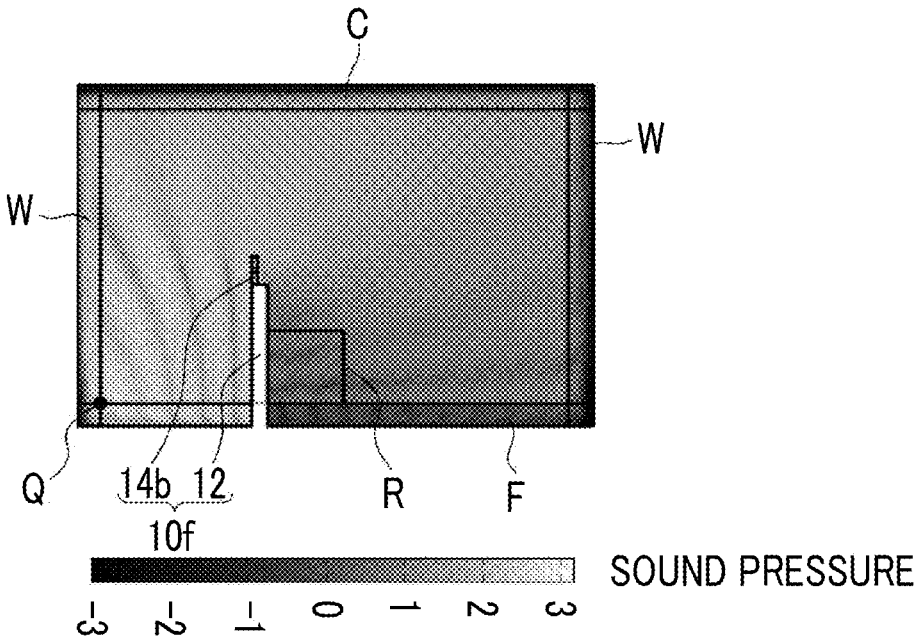
FIG. 35 is a diagram showing the calculation result of sound pressure distribution.

FIG. 35 shows a sound pressure distribution in the case of Example 4-3.

Figure 38:
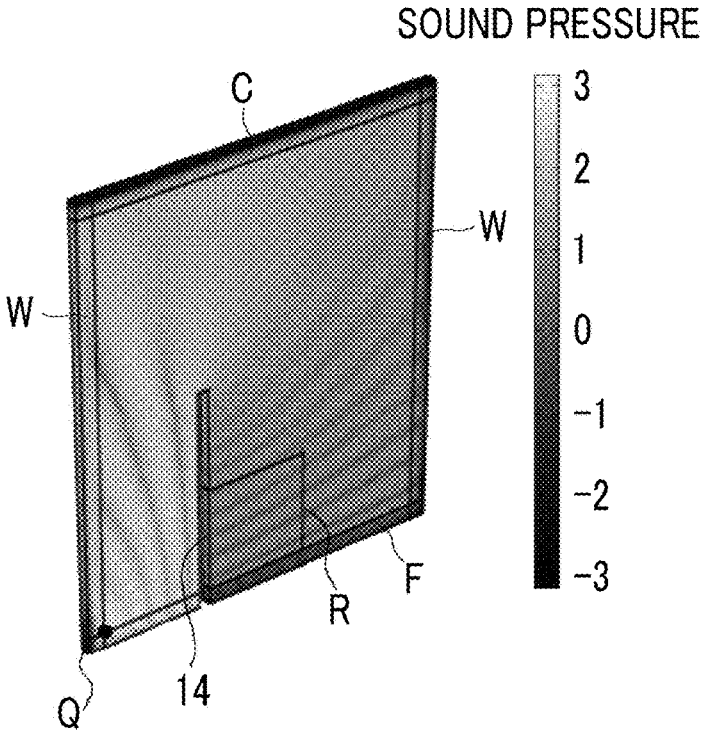
FIG. 38 is a diagram showing the calculation result of sound pressure distribution.

FIG. 38 shows a sound pressure distribution in the case of Comparative example 5-1.

Figure 39:
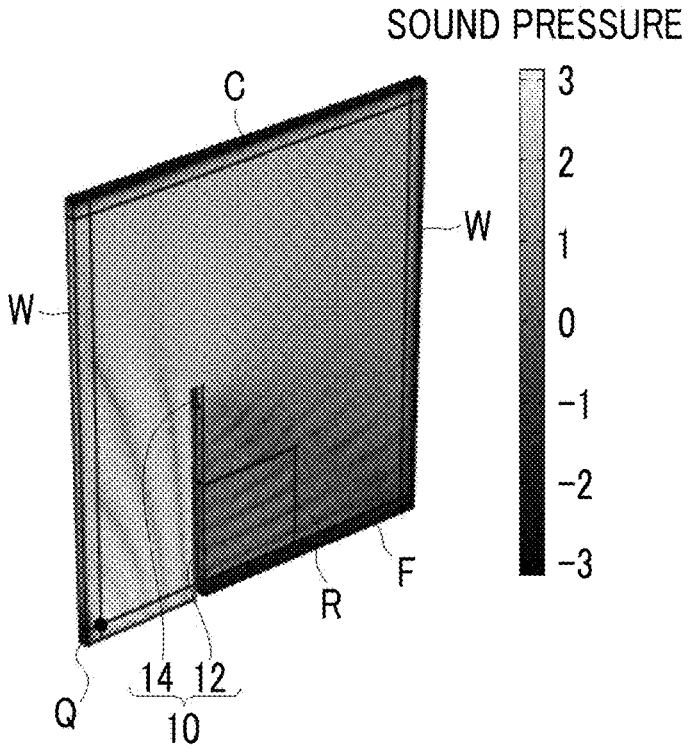
FIG. 39 is a diagram showing the calculation result of sound pressure distribution.

FIG. 39 shows a sound pressure distribution in the case of Example 5-1.

Figure 40:
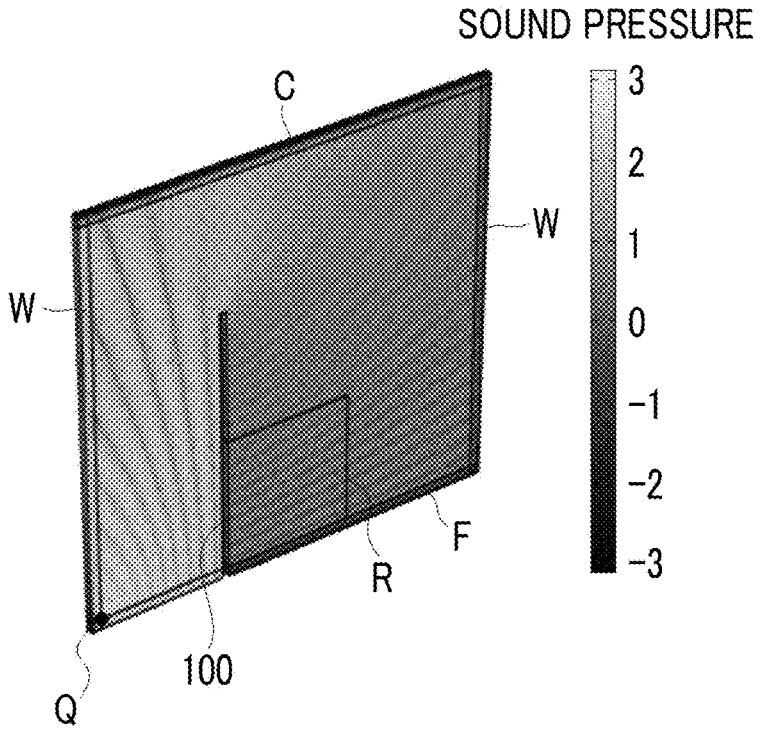
FIG. 40 is a diagram showing the calculation result of sound pressure distribution.

FIG. 40 shows a sound pressure distribution in the case of Comparative example 5-2.

Figure 41:
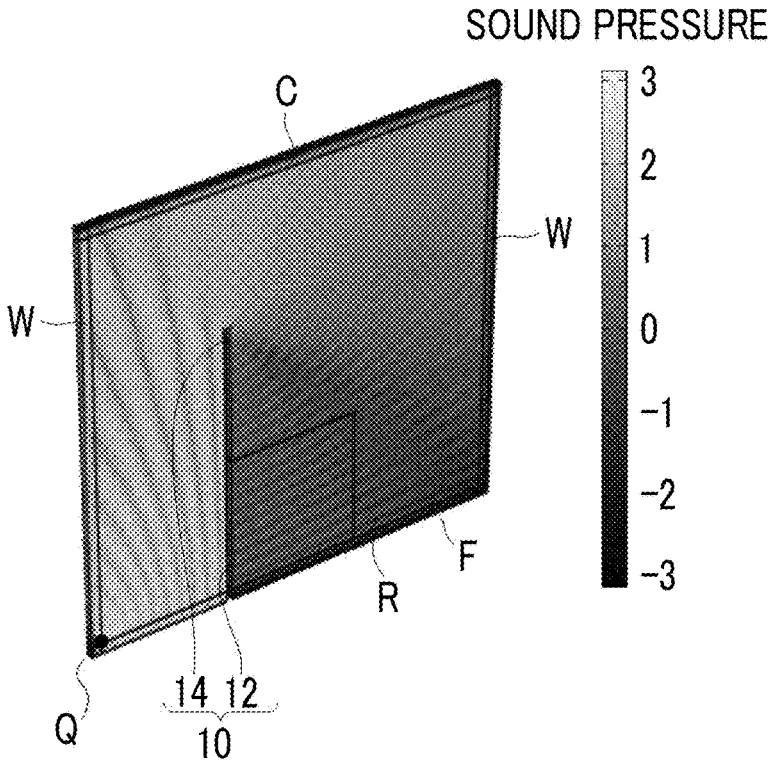
FIG. 41 is a diagram showing the calculation result of sound pressure distribution.

FIG. 41 shows a sound pressure distribution in the case of Example 5-2.

Figure 42:
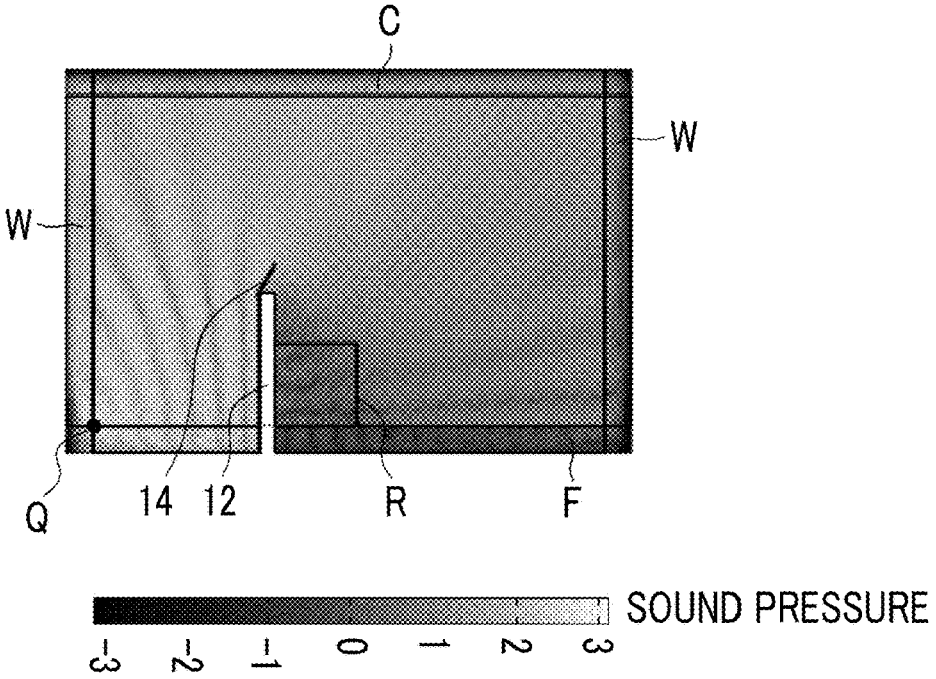
FIG. 42 is a diagram showing the calculation result of sound pressure distribution.

FIG. 42 shows a sound pressure distribution in the case of Example 6-1.

Figure 43:
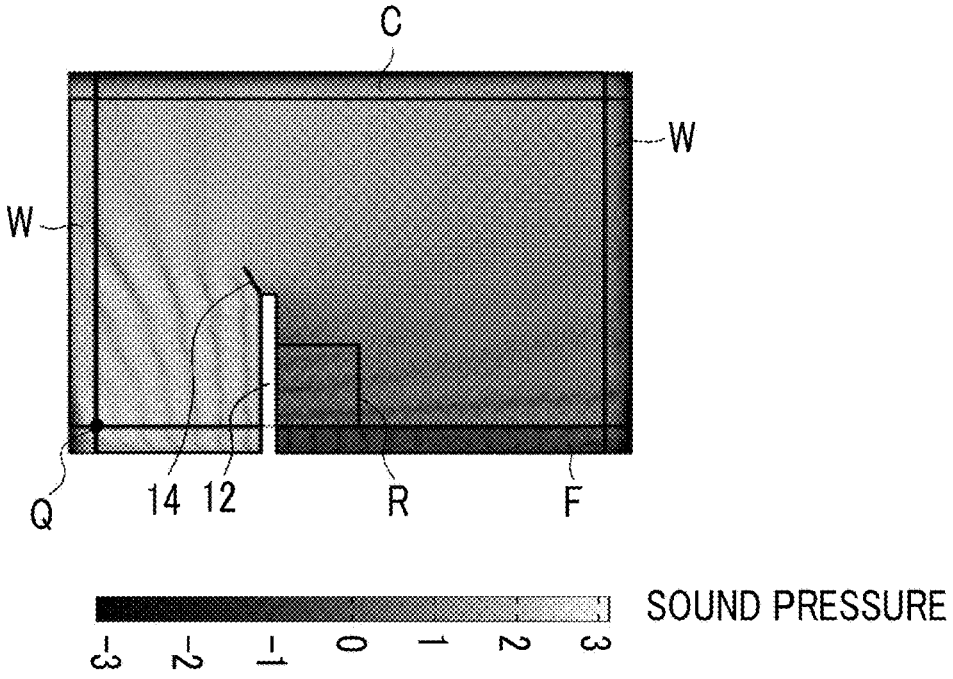
FIG. 43 is a diagram showing the calculation result of sound pressure distribution.

FIG. 43 shows a sound pressure distribution in the case of Example 6-2.

These sound pressure distributions are sound pressure distributions at a frequency of 1600 Hz except for Examples 6-1 and 6-2, and the sound pressure distributions in Examples 6-1 and 6-2 are sound pressure distributions at a frequency of 2200 Hz.

From the comparison of FIGS. 30 to 35 and FIGS. 38 to 43, it is obvious that, in the sound pressure distributions corresponding to Examples 1-1, 1-10, 4-3, 5-1, 5-2, 6-1, and 6-2 of the present invention, the sound pressure in the measurement region R is lower than that in the comparative example corresponding to each example.

Examples 7-1 to 7-5

Next, in order to examine the influence of air column resonance occurring in the opening portion 22 of the frame body 20, the simulation was performed by variously changing the thickness of the frame body 20.

Simulation was performed in the same manner as described above and in the same manner as Example 1-1 except that the film 24 was a PET film having a thickness of 188 μm, the size of the opening portion 22 of the frame body 20 was 20 mm□, and the thickness of the frame body 20 was set to 10 mm, 30 mm, 50 mm, 75 mm, and 100 mm.

The first natural vibration frequency of the film 24 fixed to the frame body 20 of 20 mm□ was 1520 Hz.

Using a region of 0.25 m×0.25 m on the surface side of the soundproof structure 10 opposite to the sound source as the measurement region R, the sound pressure in the measurement region R was calculated and the insertion loss was calculated, and the insertion loss difference ΔL with respect to the insertion loss in the case of a single partition member was calculated.

Figure 44:
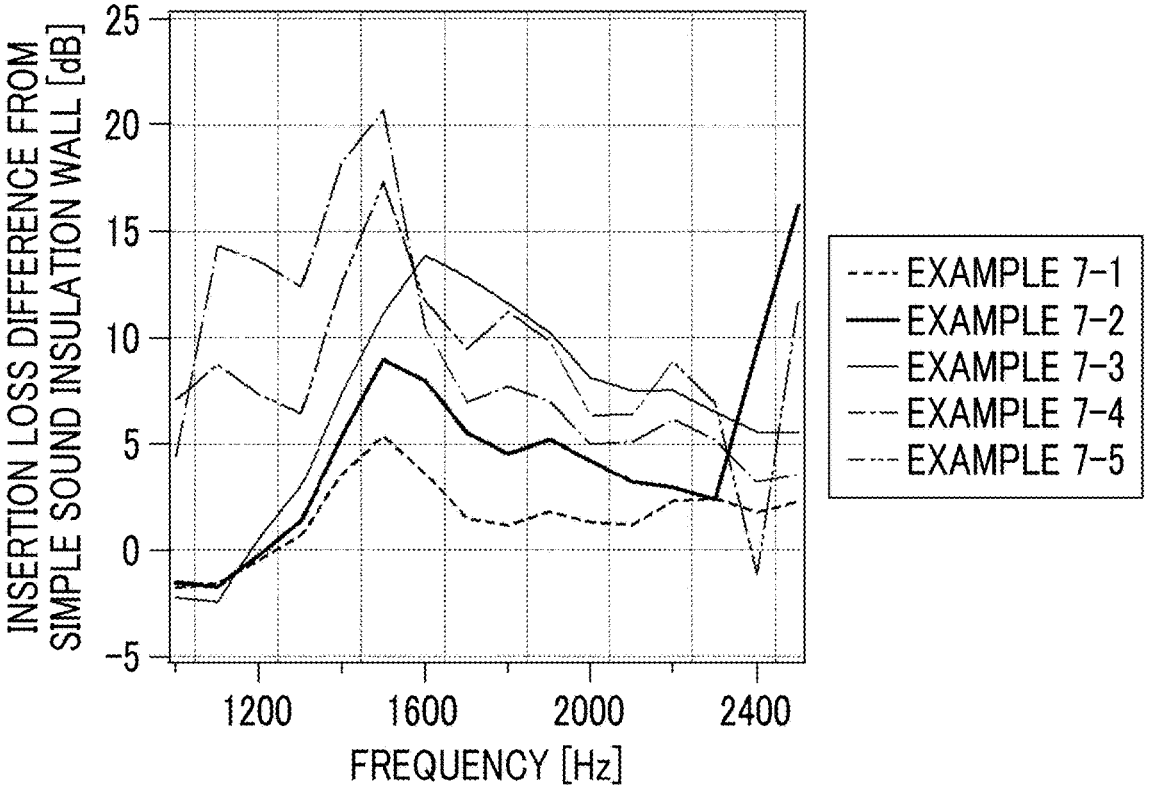
FIG. 44 is a graph showing the relationship between the frequency and the insertion loss difference.

The result is shown in FIG. 44. In addition, the value of c/(4 La) in Examples 7-1 to 7-5 is shown in Table 8.

TABLE 8

| | Thickness La (mm) of frame body | c/(4La) |
|---|---|---|
| Example 7-1 | 10 | 5079 |
| Example 7-2 | 30 | 2325 |
| Example 7-3 | 50 | 1507 |
| Example 7-4 | 75 | 1046 |
| Example 7-5 | 100 | 802 |

From FIG. 44, it can be seen that a higher insertion loss difference can be obtained in a frequency band of 2000 Hz or less in a case where c/(4 La) is 2000 or less. In addition, it can be seen that, in a case where c/(4 La) is equal to or less than the first natural vibration frequency $f_1$ of the film, a higher insertion loss difference can be obtained in a frequency band equal to or lower than the first natural vibration frequency of the film.

From the above results, the effect of the present invention is obvious.

EXPLANATION OF REFERENCES

10*a* to 10*l*: soundproof structure
12: partition member
14*a* to 14*i*: soundproof unit
20*a* to 20*d*: frame body
22: opening portion
24*a* to 24*d*: film
26: through-hole
28: adhesive
Q: sound source
S0 to S4: sound wave
W: wall surface
C: ceiling
F: floor
R: measurement region
M: microphone

What is claimed is:

1. A soundproof structure, comprising:

a soundproof unit that has a frame body, which has an opening portion passing through overall of the frame body, and a film, which is disposed so as to cover the opening portion and vibrates according to a sound incident on the film; and a partition member to which one or more soundproof units are attached, wherein the soundproof unit is disposed such that a film surface of the film is parallel to a main surface of the partition member, and wherein, a first natural vibration frequency of the film of the soundproof unit is 20000 Hz or less.

2. The soundproof structure according to claim 1, wherein, assuming that a total length of a thickness of the frame body in a penetration direction of the opening portion and an opening end correction distance is La and a sound speed in air is c, a relationship of c/(4 La)≤20000 is satisfied.

3. The soundproof structure according to claim 2, wherein, assuming that a total length of a thickness of the frame body in a penetration direction of the opening portion and an opening end correction distance is La and a sound speed in air is c, a relationship of c/(4 La)≤2000 is satisfied.

4. The soundproof structure according to claim 1, wherein, assuming that a total length of a thickness of the frame body in a penetration direction of the opening portion and an opening end correction distance is La, a first natural vibration frequency of the film is $f_1$, and a sound speed in air is c, a relationship of c/(4 La)≤$f_1$ is satisfied.

5. The soundproof structure according to claim 1, wherein the soundproof unit is attached to an end surface of the partition member.

6. The soundproof structure according to claim 5, wherein the soundproof unit is attached to the end surface of the partition member such that a film surface of the film is parallel to a main surface of the partition member.

7. The soundproof structure according to claim 1, wherein the film is formed of an air-impermeable material.

8. The soundproof structure according to claim 1, wherein the first natural vibration frequency of the film of the soundproof unit is within an audible range.

9. The soundproof structure according to claim 1, wherein two or more soundproof units are arranged on an end surface of the partition member.

10. The soundproof structure according to claim 1, wherein the film of the soundproof unit has a through-hole.

11. The soundproof structure according to claim 1, wherein the frame body and the film of the soundproof unit are transparent.

12. The soundproof structure according to claim 1, wherein the soundproof unit has at least one of an attachable and detachable portion with respect to the partition member or an attachable and detachable portion with respect to another soundproof unit.

* * * * *